US012434872B2

(12) United States Patent
Merzeau et al.

(10) Patent No.: US 12,434,872 B2
(45) Date of Patent: Oct. 7, 2025

(54) PACKAGE, ARTICLE CARRIER AND BLANK THERFOR

(71) Applicant: WestRock Packaging Systems, LLC, Atlanta, GA (US)

(72) Inventors: Julien D. Merzeau, Châteauroux (FR); Jean-Christophe Bonnain, Châteauroux (FR); Emmanuel Davaillon, Châteauroux (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 220 days.

(21) Appl. No.: 17/620,692

(22) PCT Filed: Jun. 15, 2020

(86) PCT No.: PCT/US2020/037700

§ 371 (c)(1),
(2) Date: Dec. 18, 2021

(87) PCT Pub. No.: WO2020/257096

PCT Pub. Date: Dec. 24, 2020

(65) Prior Publication Data

US 2022/0242599 A1 Aug. 4, 2022

Related U.S. Application Data

(63) Continuation-in-part of application No. 16/448,809, filed on Jun. 21, 2019, now Pat. No. 11,834,208.
(Continued)

(51) Int. Cl.
*B65B 11/00* (2006.01)
*B65B 21/24* (2006.01)
(Continued)

(52) U.S. Cl.
CPC ..... *B65B 11/004* (2013.01); *B65B 21/24* (2013.01); *B65B 41/02* (2013.01); *B65B 43/10* (2013.01)

(58) Field of Classification Search
CPC ..... B65D 71/18; B65D 71/20; B65D 71/22; B65D 71/30; B65D 71/32;
(Continued)

(56) References Cited

U.S. PATENT DOCUMENTS 2,837,262 A * 6/1958 Ullrich ..... B65D 71/18 206/434
2,888,135 A * 5/1959 Guyer ..... B65D 71/18 206/434
(Continued)

FOREIGN PATENT DOCUMENTS

CN 102686491 A 9/2012
CN 103492281 A 1/2014
(Continued)

OTHER PUBLICATIONS

Japanese Office Action dated Jan. 15, 2024, issued during the proseuction of JP 2021-576111.
(Continued)

*Primary Examiner* — Bryon P Gehman
(74) *Attorney, Agent, or Firm* — Brian J. Goldberg; Rohini K. Garg; Tsugihiko Suzuki

(57) ABSTRACT

Aspects of the disclosure relate to a package, an article carrier for packaging a plurality of articles, and a blank (10) for forming the article carrier. The article carrier comprises a plurality of panels (12,14,16,18,20,22,24) forming a tubular structure for surrounding at least one article. The article carrier comprises an article retention device for engaging a recess of at least one article to prevent or inhibit dislodgement or unintentional egress of the article from at least one
(Continued)

of opposite open ends of the tubular structure. The article retention device comprises an engaging tab (40,42) hingedly connected to one of the plurality of panels, which may be a base panel. The point of contact between the engaging tab and an inside surface of a recess in the bottom of the article is farthermost from the adjacent end edge of a respective one of a pair of bottom lap panels.

20 Claims, 13 Drawing Sheets

Related U.S. Application Data

(60) Provisional application No. 62/874,752, filed on Jul. 16, 2019.

(51) Int. Cl.
*B65B 41/02* (2006.01)
*B65B 43/10* (2006.01)
*B65D 71/18* (2006.01)

(58) Field of Classification Search
CPC ..... B65D 2571/00197; B65D 2571/00265; B65D 2571/00444; B65D 2571/00469; B65D 2571/0066; B65D 2571/00716
USPC ..... 206/434
See application file for complete search history.

(56) References Cited

U.S. PATENT DOCUMENTS

| | | | | | |
|---|---|---|---|---|---|
| 2,963,148 | A | | 12/1960 | Cote | |
| 3,049,282 | A | | 8/1962 | Chidsey et al. | |
| 3,081,928 | A | | 3/1963 | Chidsey et al. | |
| 3,134,532 | A | * | 5/1964 | Bixby | B65D 71/26 206/149 |
| 3,273,782 | A | * | 9/1966 | Chidsey, Jr. | B65D 71/34 206/149 |
| 3,314,590 | A | * | 4/1967 | Tolaas | B65D 71/32 206/149 |
| 3,347,366 | A | | 10/1967 | De Paul | |
| 3,450,332 | A | * | 6/1969 | Padovano | B65D 71/18 206/149 |
| 3,640,448 | A | | 2/1972 | Wood | |
| 9,387,968 | B2 | * | 7/2016 | Zammit | B65D 71/32 |
| 11,305,924 | B2 | * | 4/2022 | Smalley | B65D 71/20 |
| 12,006,116 | B2 | * | 6/2024 | Smalley | B65D 71/20 |
| 2015/0239628 | A1 | | 8/2015 | Zammit et al. | |

FOREIGN PATENT DOCUMENTS

| | | | | | |
|---|---|---|---|---|---|
| CN | 103534178 | B | | 9/2015 | |
| FR | 1407676 | A | | 8/1965 | |
| JP | S54-14883 | U | | 1/1979 | |
| JP | 2003034354 | A | | 2/2003 | |
| JP | 3117734 | U | | 1/2006 | |
| JP | 4016996 | B2 | | 12/2007 | |
| JP | 2014516881 | A | | 7/2014 | |
| TW | 201221439 | A | | 6/2012 | |
| TW | 201538394 | A | | 10/2015 | |
| TW | I522285 | B | | 2/2016 | |
| TW | 201832997 | A | | 9/2018 | |
| WO | WO-2005044549 | A2 | * | 5/2005 | B65D 71/12 |
| WO | 2012155024 | A2 | | 11/2012 | |
| WO | 2019099237 | A1 | | 5/2019 | |

OTHER PUBLICATIONS

Taiwan Office Action dated May 15, 2024, issued during the prosecution of Taiwan Patent Application No. 109120953.
PCT International Search Report and Written Opinion dated Sep. 4, 2020, issued during the prosecution of PCT International Patent Application No. PCT/US2020/03770.
JPO2021-576111-JP Notice of Allowance dated Sep. 30, 2024, 3 pages (no translation).

* cited by examiner

PACKAGE, ARTICLE CARRIER AND BLANK THERFOR

TECHNICAL FIELD

The present invention relates to article carriers and to blanks for forming the same. More specifically, but not exclusively, the invention relates to a wraparound carrier having an article retention structure including an engagement device for securing a lower end of an article.

BACKGROUND

In the field of packaging it is known to provide cartons or article carriers for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is desirable that the articles held within a carton are securely held and protected during transportation.

The present invention seeks to provide an improvement in the field of cartons, typically formed from paperboard or the like.

SUMMARY

A first aspect of the invention provides an article carrier for packaging one or more articles each having a recess in a bottom wall. The article carrier comprises a plurality of panels, forming a tubular structure for surrounding at least one article, including a base panel. The article carrier comprises an article retention structure for engaging a recess of one of said articles to prevent or inhibit dislodgement or unintentional egress of the article from at least one of opposite open ends of the tubular structure. The article retention structure comprises an engaging tab hingedly connected to the base panel. The engaging tab may be arranged to contact an inside surface of the recess in the bottom wall of the article at a point farthermost from the adjacent end edge of the base panel of the article carrier.

Optionally, the base panel is formed from a pair of bottom lap panels.

Optionally, the engaging tab is hingedly connected to the base panel by a fold line.

Optionally, the fold line of the engaging tab is arranged to terminate at a position on a bottom chime of an article which is farthermost from the adjacent end edge of the base panel.

Optionally, the fold line is arranged to pass through the centre of the recess in the bottom wall of the article.

Optionally, the fold line is arranged to intersect with a cylindrical axis of the article.

Optionally, the length of the fold line is equal to, or greater than, half of the diameter of the bottom chime of the article.

Optionally, the length of the fold line is equal to, or greater than, half of the diameter of the recess in the bottom wall of the article.

Optionally, the fold line is parallel to a tubular axis of the carrier.

Optionally, the fold line is oriented longitudinally of the carrier.

Optionally, the width of the engaging tab is greater than the distance between the fold line and an adjacently disposed machine access opening.

Optionally, the fold line intersects with a notional line oriented transversely of the carrier and passing through an inner end of an adjacent machine access opening.

Optionally, the fold line intersects with a notional line oriented transversely of the carrier and passing through an outer end of an adjacent male locking tab or female locking tab.

A second aspect of the invention provides an article carrier for packaging at least one article each having a recess in a bottom wall. The article carrier comprises a plurality of panels, including a base panel, forming a tubular structure for surrounding at least one article. The article carrier comprises an article retention structure for engaging a recess of an article to prevent or inhibit dislodgement or unintentional egress of the article from at least one of opposite open ends of the tubular structure. The article retention structure comprises an engaging tab hingedly connected to the base panel by a fold line. The width of the engaging tab may be greater than the distance between the fold line and an adjacently disposed machine access opening.

A third aspect of the invention provides an article carrier for packaging at least one article each having a recess in a bottom wall. The article carrier comprises a plurality of panels forming a tubular structure for surrounding at least one article. The plurality of panels includes a pair of bottom lap panels forming a composite base panel. A first one of the pair of bottom lap panels comprises at least one male locking tab. A second one of the pair of bottom lap panels comprises at least one female locking tab. The article carrier comprises at least one article retention structure for engaging a recess of an article to prevent or inhibit dislodgement or unintentional egress of the article from at least one of opposite open ends of the tubular structure. The article retention structure comprises an engaging tab hingedly connected to one of the pair of bottom lap panels by a fold line. The fold line may intersect with a notional line oriented transversely of the article carrier and passing through an outer end of an adjacent male locking tab or female locking tab.

A fourth aspect of the invention provides an article carrier for packaging at least one article each having a recess in a bottom wall. The article carrier comprises a plurality of panels forming a tubular structure for surrounding at least one article. The plurality of panels includes a pair of bottom lap panels forming a composite base panel. The article carrier comprises an article retention structure for engaging a recess of an article to prevent or inhibit dislodgement or unintentional egress of the article from at least one of opposite open ends of the tubular structure. The article retention structure comprises at least one engaging tab hingedly connected to one of the pair of bottom lap panels. The article carrier may comprise a panel locking device including a locking tab formed solely from one of the pair of bottom lap panels and hingedly connected thereto by a fold line. The panel locking device may include a hooking element defined in part by a cutline in said one of the pair of bottom lap panels in which the locking tab is formed. The locking tab has a width dimension which may be greater than a distance between the fold line and the cutline defining the hooking element of the panel locking device.

Optionally, the fold line is spaced apart from a notional line oriented transversely of the article carrier and passing through an outer end of the cutline.

Optionally, the fold line intersects with a notional line oriented transversely of the article carrier and passing through an inner end of the cutline.

A fifth aspect of the invention provides a package comprising the combination of an article carrier and at least one article having a recess in a bottom wall. The article carrier comprises a plurality of panels forming a tubular structure for surrounding the at least one article. The article carrier comprises an article retention structure for engaging a recess of one of said at least one article to prevent or inhibit dislodgement or unintentional egress of the article from at least one of opposite open ends of the tubular structure. The article retention structure comprises an engaging tab hingedly connected to one of the plurality of panels, said one of the plurality of panels may be a base panel. The point of contact between the engaging tab and an inside surface of a recess in the bottom of the article may be farthermost from the adjacent end edge of a respective one of a pair of bottom lap panels.

A sixth aspect of the invention provides a blank for forming an article carrier. The blank comprises a plurality of panels for forming a tubular structure for surrounding one or more articles each having a recess in a bottom wall. The blank comprises an article retention structure for engaging a recess in one of said articles to prevent or inhibit dislodgement or unintentional egress of the article from a set-up article carrier. The article retention structure comprises an engaging tab hingedly connected to the base panel by a fold line. The width of the engaging tab may be greater than the distance between the fold line and an adjacently disposed machine access opening.

A seventh aspect of the invention provides a blank for forming an article carrier. The blank comprising a plurality of panels for forming a tubular structure for surrounding one or more articles each having a recess in a bottom wall. The blank comprises a pair of bottom lap panels forming a composite base panel. A first one of the pair of bottom lap panels comprises at least one male locking tab. A second one of the pair of bottom lap panels comprises at least one female locking tab. The blank comprises at least one article retention structure for engaging a recess of one of said articles to prevent or inhibit dislodgement or unintentional egress of the article from a set-up article carrier. The article retention structure comprises an engaging tab hingedly connected to one of the pair of bottom lap panels by a fold line. The fold line may intersect with a notional line oriented longitudinally of the blank and passing through an outer end of an adjacent male locking tab or female locking tab.

An eighth aspect of the invention provides a blank for forming an article carrier. The blank comprises a plurality of panels for forming a tubular structure for surrounding one or more articles each having a recess in a bottom wall. The blank comprises a pair of bottom lap panels forming a composite base panel. The blank comprises an article retention structure for engaging a recess of one of said articles to prevent or inhibit dislodgement or unintentional egress of the article from a set-up article carrier. The article retention structure comprises at least one engaging tab hingedly connected to one of the pair of bottom lap panels. The blank may comprise a panel locking device including a locking tab formed solely from one of the pair of bottom lap panels and hingedly connected thereto by a fold line. The panel locking device may include a hooking element defined in part by a cutline in said one of the pair of bottom lap panels in which the locking tab is formed. The locking tab has a width dimension which may be greater than a distance between the fold line and the cutline.

A ninth aspect of the invention provides a package which comprises a group of articles and an article carrier. Each article of the group has a cylindrical portion and a bottom chime. The cylindrical portion has a first diameter while the bottom chime has a chime diameter which is less than the first diameter. The bottom chime defines a recess at a bottom of each article. The article carrier comprises a plurality of panels, including a base panel, forming a tubular structure surrounding the group of articles and an article retention structure disposed in engagement with the recess of an endmost one of the articles to prevent or inhibit egress of the endmost article from at least one of opposite open ends of the tubular structure. The article retention structure comprises an engaging tab hingedly connected to the base panel. The engaging tab is arranged to engage the inside surface of the recess of the endmost article such that a part of the bottom chime of the endmost article extends outwardly beyond an adjacent end edge of the base panel.

Optionally, the engaging tab may be formed entirely from the base panel.

Optionally, the tubular structure may define a tubular axis of the carrier, and the engaging tab may be hingedly connected the base panel along a tab fold line that is parallel to the tubular axis.

Optionally, the plurality of panels may further include a first panel hingedly connected to the base panel along a first fold line which is parallel to the tubular axis. The engaging tab may be folded about the tab fold line to extend away from the first fold line such that the engaging tab engages the recess.

Optionally, the length of the tab fold line may be equal to, or greater than, a half of the chime diameter.

Optionally, the engaging tab may be disposed to engage the inside surface of the recess at a point farthermost from the adjacent end edge of the base panel.

Optionally, the distance between the farthermost point and the adjacent edge of the base panel may be less than the chime diameter.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the package, blanks and article carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and article carriers described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
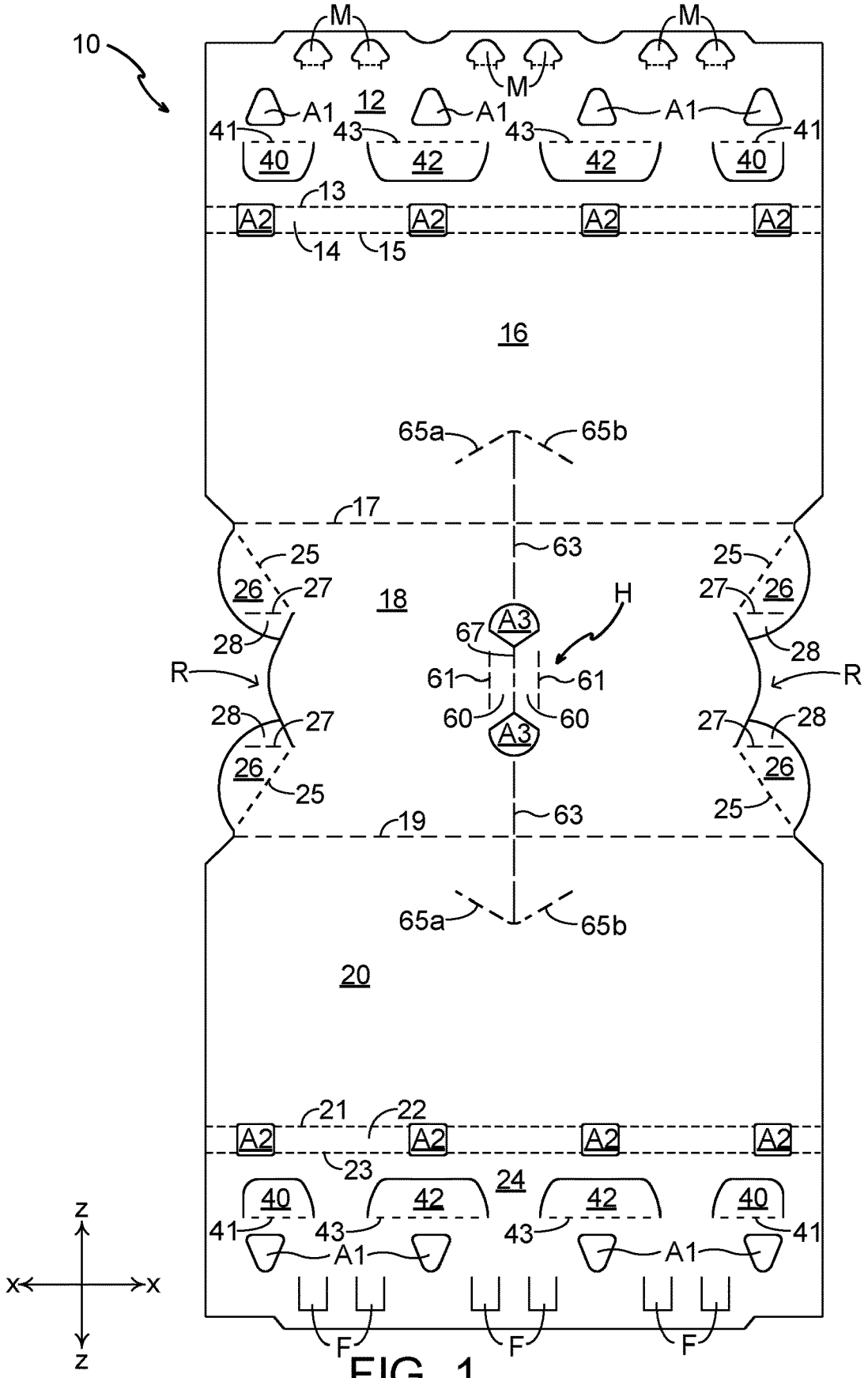
FIG. 1 is a plan view from above of a blank for forming an article carrier according to a first embodiment.

Referring to FIG. 1, there is shown a plan view of a blank 10 capable of forming a carton or carrier (not shown), for containing and carrying a group of primary products such as, but not limited to, beverage cans, hereinafter referred to as articles. The blank 10 can be assembled to form a secondary package for packaging at least one primary product container or package. Alternative blanks 110, 210, 310, 410 are shown in FIGS. 2, 3, 4, and 5. Alternative carriers 590, 690, are shown in FIGS. 6, 7, 8, 9, and 10.

In the embodiments detailed herein, the terms "carton" and "carrier" refer, for the non-limiting purpose of illustrating the various features of the invention, to a container 590, 690 for engaging and carrying articles B, such as primary product containers B. It is contemplated that the teachings of the invention can be applied to various product containers B, which may or may not be tapered and/or cylindrical. Other exemplary containers include bottles (for example metallic, glass or plastics bottles), cans (for example aluminium cans), tins, cups, pots, pouches, packets and the like.

The blanks 10, 110, 210, 310, 410 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structures or carton 590, 690 described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the embodiment illustrated in FIG. 1 the blank 10 is configured to form a carton or carrier for packaging an exemplary arrangement of exemplary articles. In the illustrated embodiments the arrangement is an m×n matrix or array, having two rows (m=2) and four columns (n=4); in the illustrated embodiments two rows of four articles are provided, and the articles are 330 ml beverage cans. In the embodiments illustrated in FIGS. 2, 3, 4 and 5 the blanks 110, 210, 310, 410 are configured to form a carton or carrier for packaging an exemplary arrangement of exemplary articles. In the illustrated embodiments the arrangement is an m×n matrix or array, having two rows (m=2) and three columns (n=3); in the illustrated embodiments two rows of three articles are provided, and the articles are 330 ml beverage cans. In the embodiment illustrated in FIGS. 6 and 7 a carton or carrier 590 is shown packaging an exemplary arrangement of exemplary articles B. In the illustrated embodiment the arrangement is an m×n matrix or array, having two rows (m=2) and four columns (n=4); in the illustrated embodiments two rows of four articles B are provided, and the articles B are 330 ml beverage cans. In the embodiment illustrated in FIGS. 8, 9 and 10 a carton or carrier 690 is shown packaging an exemplary arrangement of exemplary articles B. In the illustrated embodiment the arrangement is an m×n matrix or array, having two rows (m=2) and three columns (n=3); in the illustrated embodiments two rows of four articles B are provided, and the articles B are 330 ml beverage cans.

Alternatively, the blanks 10, 110, 210, 310, 410 or article carriers 590, 690 can be configured for packaging other types, number and size of articles B and/or for packaging articles B in a different arrangement or configuration for example, but not limited to, fully enclosed cartons or basket carriers, the articles B may be bottles or cans.

Turning to FIG. 1, there is illustrated a blank 10 for forming an article carrier (not shown) according to an embodiment of the disclosure. The blank 10 comprises a plurality of main panels 12, 14, 16, 18, 20, 22, 24 for forming a tubular structure. The plurality of main panels 12, 14, 16, 18, 20, 22, 24 comprises: a first base panel 12, a first corner or bevel panel 14, a first side panel 16, a top panel 18, a second side panel 20, a second corner or bevel panel 22 and a second base panel 24. The plurality of panels 12, 14, 16, 18, 20, 22, 24 may be arranged in a linear series hinged one to the next by corresponding fold lines 13, 15, 17, 19, 21, 23.

In alternative embodiments, the first and second corner panels 14, 22 may be omitted.

Fold line 13, fold line 15, fold line 21 and fold line 23 optionally comprise cut lines or severance lines (not shown) which are collinear with the respective one of the fold lines 13, 15, 21, 23 so as to interrupt said fold line 13, 15, 21, 23 or be coincident therewith. The severance lines may provide shock absorbing or damping devices proximate the base of the carton.

The first and second corner panels 14, 22 may be considered to form lower portions of the respective one of the first or second side panels 16, 24, or alternatively form part of the first or second base panels 12, 24 to which they are hingedly connected.

The blank 10 is foldable to form a package. The first and second base panels 12, 24 are engageable with one another in an overlapping relationship to form a composite base wall 12/24 of the carton. The blank 10 may comprise a complementary locking mechanism for securing the second base panel 24 to the first base panel 12. The second base panel 24 may comprise at least one first part F of the complementary locking mechanism. The first base panel 12 may comprise at least one second part M of the complementary locking mechanism. In the illustrated embodiment, the second base panel 24 comprises a plurality of female tabs F defining openings in the second base panel 24. The first base panel 12 comprises a plurality of male tabs M; and the openings in the second base panel 24 are configured to receive a respective one of the male tabs M. The female tabs F are arranged to be displaced out of the second base panel 24 to form the opening and to bear against the male tabs M when received therein. In some embodiments the complementary locking mechanism M/F may be omitted; and the first and second base panels 12, 24 may be secured to each other by other means such as but not limited to adhesive or staples.

Optionally, the first and second base panels 12, 24 may comprise at least one first aperture A1 (also referred to herein as a machine access opening). In the illustrated embodiment, each of the first and second base panels 12, 28 comprises four first apertures A1. The first apertures A1 may be employed to facilitate construction of the carton. A packaging machine component may engage with the first apertures A1 to enable the plurality of panels 12, 14, 16, 18, 20, 22, 24 to be tightened about a group of articles. The first apertures A1 may also be employed to facilitate alignment of the first and second base panels 12, 28 with respect to each other or to align the first part F of the complementary locking mechanism with the second part M of the complementary locking mechanism.

The complementary locking mechanism illustrated and described is entirely optional.

The blank 10 comprises at least one article retention device or article engagement structure for engaging an upper end of the articles B. The blank 10 illustrated in FIG. 1 comprises four article engagement structures.

Each of the article engagement structures comprises a flap 26 hingedly connected to the top panel 18. A first pair of article engagement structures comprises a pair of flaps 26 hingedly connected to a first end of the top panel 18. A second pair of article engagement structures comprises a pair of flaps 26 hingedly connected to a second end of the top panel 18.

The flap 26 of each of the first pair of article engagement structures is inset from a first outer edge of the blank 10.

The flap 26 of each of the first pair of article engagement structures may be inset with respect to a first end edge of the first or second side panels 16, 20.

The flap 26 of each of the first pair of article engagement structures may be inset with respect to marginal edge portions of the top panel 18.

The flap 26 of each of the first pair of article engagement structures may be inset from a first free end edge of the top panel 18.

The flap 26 of each of the second pair of article engagement structures is inset from a second outer edge of the blank 10.

The flap 26 of each of the second pair of article engagement structures may be inset with respect to a second end edge of the first or second side panels 16, 20.

The flap 26 of each of the second pair of article engagement structures may be inset with respect to marginal edge portions of the top panel 18.

The flap 26 of each of the second pair of article engagement structures may be inset from a second free end edge of the top panel 18.

A recess R is provided in the first end of the top panel 18, the flaps 26 of the first pair of article engagement structures can be considered to be located in the recess R. The flaps 26 of the first pair of article engagement structures define in part the recess R and when folded out of the plane of the top panel 18 increase the size of the recess R.

The recess R is arranged to accommodate the entirety of the flaps 26 and wing tabs 28 when present.

The flaps 26 of the first pair of article engagement structures are hingedly connected to the top panel 18 by hinged connections in the form of fold lines 25 which are obliquely oriented with respect to the fold lines 17, 19.

The fold line 25 hinging one of the flaps 26 of the first pair of article engagement structures to the top panel 18 is divergently arranged with respect to the fold line 25 hinging the other one of the flaps 26 of the first pair of article engagement structures to the top panel 18.

The fold lines 25 hinging the flaps 26 of the first pair of article engagement structures are arranged to diverge towards the first end of the top panel 18.

The fold lines 25 hinging the flaps 26 of the first pair of article engagement structures are arranged to converge towards the centre or middle of the top panel 18.

A recess R is provided in the second end of the top panel 18, the flaps 26 of the second pair of article engagement structures can be considered to be located in the recess R. The flaps 26 of the second pair of article engagement structures define in part the recess R and when folded out of the plane of the top panel 18 increase the size of the recess R.

The recess R is arranged to accommodate the entirety of the flaps 26 and wing tabs 28 when present.

The flaps 26 of the second pair of article engagement structures are hingedly connected to the top panel 18 by hinged connections in the form of fold line 25 which are obliquely oriented with respect to the fold lines 17, 19.

The fold line 25 hinging one of the flaps 26 of the second pair of article engagement structures to the top panel 18 is divergently arranged with respect to the fold line 25 hinging the other one of the flaps 26 of the second pair of article engagement structures to the top panel 18.

The fold lines 25 hinging the flaps 26 of the second pair of article engagement structures are arranged to diverge towards the second end of the top panel 18.

The fold lines 25 hinging the flaps 26 of the second pair of article engagement structures are arranged to converge towards the centre or middle of the top panel 18.

In the blank form the flaps 26 define in part free end edges of the top panel 18. The edge portions of the top panel 18 defined by the flaps 26 are arcuate or curvilinear in shape.

Each of the article engagement structures may comprise a wing tab 28 hingedly connected to the flap 26 by a hinged connection in the form of a fold line 27.

The fold line 27 may form a keel when the article engagement structures are in use engaging an article. The keel may form a ridge to increase stability or rigidity of the article engagement structures. The flap 26 and the wing tab 28 may adopt a non-coplanar arrangement, for example, but not limited to, when an article moves outwardly through the open end of the tubular structure forming the article carrier. The wing tab 28 may fold with respect to the flap 26.

The fold line 27 may be obliquely oriented with respect to the fold line 25 and may define an acute angle therebetween.

The wing tabs 28 are connected only to the flaps 26 and are free from connection to the top panel 18 other than the indirect connection by virtue of being coupled to the flaps 26, that is to say there is no direct connection of the wing tabs 28 to the top panel 18. The flaps 26 interconnect the wing tabs 28 and the top panel 18.

The wing tabs 28 may be separated from the top panel 18 by a cutaway in the form of a recess or cutline. In some embodiments the wing tab 28 may be omitted and a portion of the flap 26 may be separated from the top panel 18 by a cutaway in the form of a recess or cutline.

In the unfolded condition in the blank 10 the fold lines 27 are oriented substantially parallel with the fold lines 17, 19 hinging the side panels 16, 20 to the top panel 18.

When the flaps 26 are folded about their respective fold line 25 into face to face relationship with the top panel 18, the fold lines 27 may be obliquely oriented with respect to the fold lines 17, 19.

The blank 10 may comprise at least one heel relief device, the heel relief device comprises an opening. The opening is defined at least in part by a heel aperture A2. The heel aperture A2 is struck, at least in part, from the first or second corner panel 14, 22. The heel relief devices may serve to reduce pressure or stress on the carrier when assembled about an article. The heel relief devices may serve to reduce deformation of the carrier, specifically the first or second corner panels 14, 22 and adjacent regions of the side and base panels 16, 20; 12, 28 when assembled about an article.

The blank 10 may comprise at least one lower article engagement or retention structure for engaging with a base or end portion of an article. The blank 10 illustrated in FIG. 1 comprises eight lower article retention structures each for engaging a respective article. Four lower article retention structures are provided in the first base panel 12 and four lower article retention structures are provided in the second base panel 24.

The blank 10 comprise a plurality of lower article retention structures, the illustrated embodiment provides a lower article retention structure for engaging each of the articles disposed in the carrier.

The plurality of lower article retention structures comprises endmost lower article retention structures (also referred to herein as partial lower article retention structures) for engaging articles disposed proximate the first and second ends of the carrier. The endmost lower article retention structures each comprise a first engaging tab 40 struck from, or defined within, one of the first and second base panels 12, 24. The first engaging tab 40 (also referred to herein as a partial engaging tab 40) is hingedly connected to said one of the first and second base panels 12, 24 by a hinged connection in the form of a fold line 41.

The plurality of lower article retention structures comprises intermediate lower article retention structures (also referred to herein as full lower article retention structures) for engaging articles disposed medially of the carrier, that is to say articles disposed between endmost articles. The intermediate lower article retention structures each comprise a second engaging tab 42 struck from, or defined within, one of the first and second base panels 12, 24. The second engaging tab 42 (also referred to herein as a full engaging tab 42) is hingedly connected to said one of the first and second base panels 12, 24 by a hinged connection in the form of a fold line 43.

During the erection and packaging of articles B, the blank 10 is manipulated so that the engaging tabs 40, 42 are also folded internally of the carton. The engaging tabs 40, 42 are folded about their respective fold lines 41, 43 out of the plane of the first and second base panels 12, 24 greater than 90° to engage an article. The engaging tabs 40, 42 are received in a recess in the base of the article. Each article may comprise a concave or curved base which forms the recess, the recess may take the form of a domed ceiling. The engaging tabs 40, 42 comprise at least one engaging edge, the engaging edge or edges may be an end edge or edges of the engaging tabs 40, 42. The end edge or edges are disposed adjacent to a hinged edge defined by the hinged connection to the base panel 12, 24. The engaging tabs 40, 42 facilitate securing or locking the base of an article B in position.

The top panel 20 may comprise an optional handle structure H.

The blank 10 may comprise a handle structure H. The handle structure H may be provided at least in part in the top panel 18. The handle structure H comprises a handle opening or slot defined in the top panel 18. The handle opening may be defined at least in part by a pair of handle tabs 60. The handle tabs 60 are struck from the top panel 18 and is hingedly connected thereto by a hinged connection in the form of a fold line 61. The handle tabs 60 are hinged in opposition to the each other. The handle tabs 60 are separated from, or severable from, each other by a common first cut line or severance line 67.

The handle opening may be defined at least in part by a pair of handle apertures A3 struck from the top panel 18 and disposed at opposed ends of the handle tabs 60.

The handle structure H may extend into the adjacent panels, into the first side panel 16 and into the second side panel 20. A second severance line 63 may extend across the top panel 18, the severance line 63 is interrupted by the handle opening. The first and second severance lines 67, 63 are collinearly arranged with each other. The second severance line 63 may extend into each of the first and second side panels 16, 20. A first severance line extension may be provided in the first side panel 16. A second severance line extension may be provided in the second side panel 20. The handle structure H comprises a relief structure at each end of the first and second severance line extensions, the relief structure may redirect or distribute load forces in the handle structure through the carton and or onto the contents (articles B) in the carton.

The relief structure comprises a cutline extending from the end of the first and second severance line extensions. Each cutline is divergently arranged with respect to the first and second severance line extensions from which it extends. The cut line may be 'V' or 'U' shaped. Each cut line is arranged so as to converge at the end of the first and second severance line extension. The cutline and the respective first or second severance line extension diverges from the respective first or second severance line extensions towards the top panel 18. The relief structure comprises a pair of divergently arranged fold lines 65*a*, 65*b*, extending from the cutline towards the top panel 18.

Figure 2:
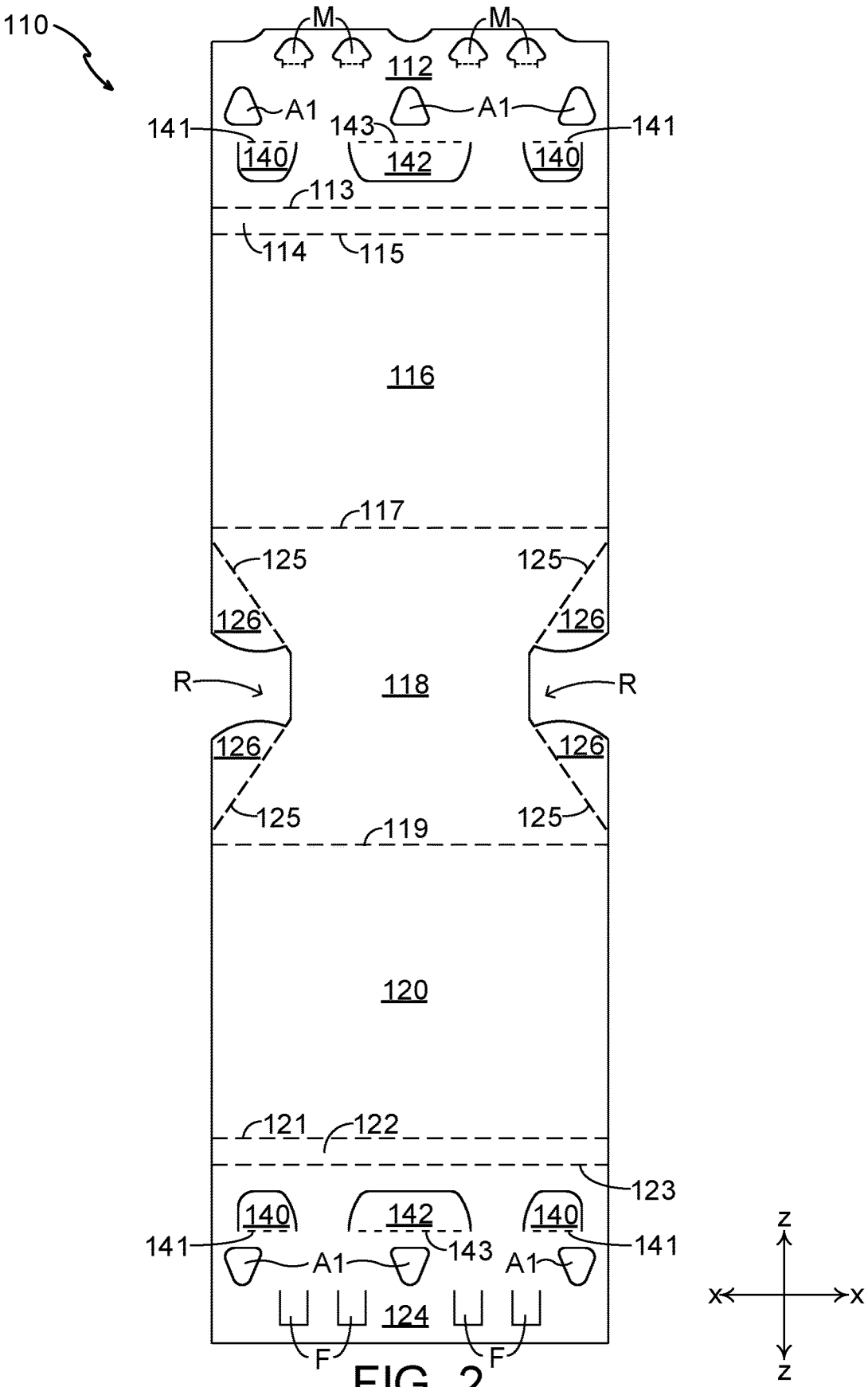
FIG. 2 is a plan view from above of a blank for forming an article carrier according to a second embodiment.

Referring now to FIG. 2, there is shown an additional embodiment of the present disclosure. In the second illustrated embodiment like numerals have, where possible, been used to denote like parts, albeit with the addition of the prefix "100" to indicate that these features belong to the second embodiment. The additional embodiment shares many common features with the first embodiment and therefore only the differences from the embodiment illustrated in FIG. 1 will be described in detail.

In the embodiments of FIG. 2 the relief apertures A2 of the previous embodiment have been omitted. The handle structure has also been omitted.

The article engagement structures may consist of a flap 126, the wing tab has been omitted. The flaps 126 are hinged to the top panel 118 by a hinged connection in the form of a fold line 125. The cutline separating the wing tab and/or flap 126 from the top panel 118 has been omitted.

The flaps 126 comprise a substantially triangular shape. The fold line 125 may be linear. The flaps 126 comprise a first free edge and a second free edge. The first free edge may be arcuate or curvilinear and provides an engaging edge. The second edge may be linear and define an acute angle with the fold line 125. The second edge is collinearly arranged with end edges of the first and second side panels 116, 120, in this way the second edge of each flap 126 is coincident with an end edge of the blank 110; that is to say the second edges of the flaps 126 define a portion of the end edge of the blank 110.

The first edges of the flaps 126 define a portion of a recess R struck from or defined in an end edge of the top panel 118. The recesses R increase in size when the flaps 126 are folded with respect to the top panel 118; that is to say the flaps 126 form or define parts of a cutaway in the end edge of the top panel 118.

The recesses R are defined only in the top panel 118. The first and second side panels 116, 120 comprise square upper corners, whereas in the previous embodiment the upper corners of the first and second side panels 16, 20 are filleted, chamfered or bevelled.

Figure 2B:
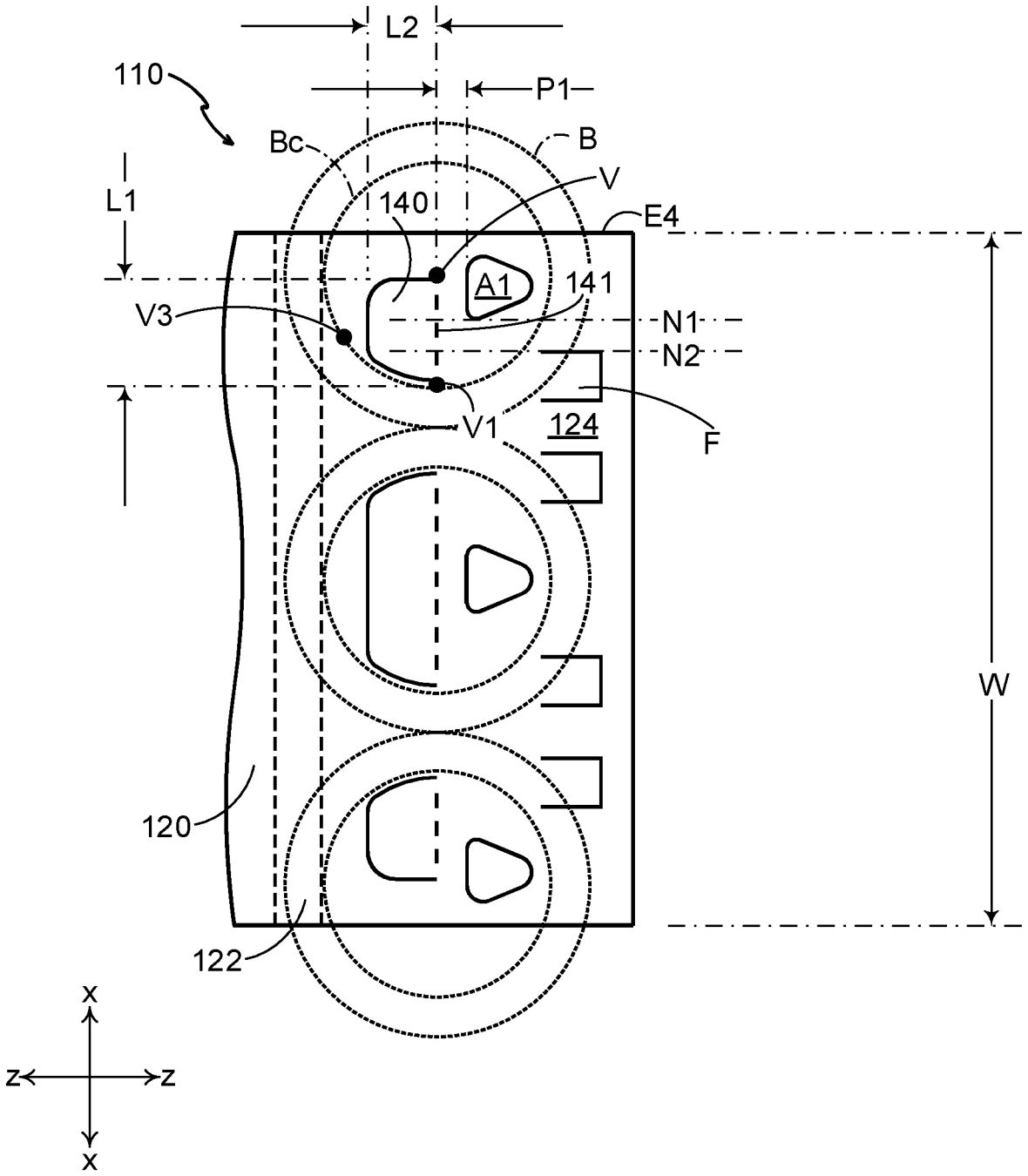
FIG. 2B is an enlarged plan view from above of a portion of the blank of FIG. 2.

FIG. 2B shows a portion of the blank 110, the second base panel 124, in relation to the bases of a row of articles B.

The engaging tab 140 contacts the bottom of an article B at a contacting point V1, the contacting point V1 is located on an inside edge or surface of the recess in the base of the article B. The inside edge or surface of the recess in the base of the article B is indicated by a phantom or dashed line denoted by reference Bc; The phantom line Bc may indicate the location of a chime of an end of a beverage can. The contacting point V1 is located on an innermost portion of the recess of the article B. The contacting point V1 and the central or tubular axis V2 of the article B define a notional line extending in a lateral direction with respect to the blank 110. The lateral axis or direction is denoted by direction arrow x-x. A longitudinal direction of the blank 110 is denoted by direction arrow z-z.

The lateral axis x-x of the blank 110 is parallel to a tubular axis of the carrier. The longitudinal direction z-z of the blank 110 is parallel to a transverse axis or direction of the carrier and perpendicular to the tubular axis of the carrier formed from the blank 110.

The fold line 141 of the engaging tab 140 terminates approximately at a position V1 on the bottom chime Bc of the article B, the position V1 is farthermost from the adjacent end edge E4 of the second base panel 124 (also referred to herein as a bottom lap panel).

The contacting point V1 is located at an innermost end of the fold line 141 hinging the engaging tab 140 the second base panel 124. The fold line 141 may terminate at the location of the tubular axis V2.

The engaging tab 140 has a length L1 and a width or height L2. The engaging tab 140 is spaced apart from the first aperture A1 by a first distance P1.

The fold line 141 intersects with the cylindrical axis V2 of the article B or passes through the centre V2 of the end or chime Bc of the article B. The length L1 of the fold line 141 is equal to, or greater than, a half of the diameter of the bottom chime Bc or recess in the bottom wall of the article B.

The fold line 141 is parallel to the tubular axis of the carrier formed from the blank 110.

The width or height L2 of the engaging tab 140 is greater than the first distance P1 between the fold line 141 and the adjacent machine access opening A1.

The fold line 141 intersects with a notional line N1-N1 that is parallel to the longitudinal axis z-z of the blank 110. The notional line N1-N1 passes through, intersects or contacts an inner end of a machine access opening A1 located adjacent to the engaging tab 140.

The fold line 141 extends away from the adjacent end edge E4 of the second base panel 124 beyond the inner end of the machine access opening A1.

The fold line 141 intersects with a notional line N2-N2 that is parallel to the longitudinal axis Z-Z of the blank 110. The notional line N2-N2 passes through the outermost end of the adjacent female locking tab F. The outer end is defined by a side edge of the female locking tab F located in closest proximity to the end edge E4 of the second base panel 124. The first base panel 112 is similarly arranged albeit the notional line passes through the outermost end of the male locking tab M.

The arrangement of the contacting point V1 of the engaging tab 140 with respect to the article B allows the width W of the blank 110 to be reduced compared to an engaging tab in which the contacting point between the engaging tab and the chime Bc is located closer to the end edge E4 of the blank 110, point V3 shows one such exemplary contact point.

Portions of the endmost articles B may protrude from the carrier.

The engaging tab 140 engages the recess in the base of the article B. The perimeter of the recess at the point of contact between the article B and the second base panel 124 is denoted by dashed line Bc. The engaging tab 140 engages the recess in the base of the article B at an innermost point V1 on the recess.

The fold line 141 is arranged to extend radially with respect to the article B.

The fold line 141 extends along a portion of a radius of the article B which is parallel with the tubular axis of the carrier, said radius extending from the tubular axis V2 of the article B towards an adjacently disposed article B.

The second or full engaging tabs 42 arranged to extend across the recess in the base of the article B. The second or full engaging tabs 42 comprise two contacting points on opposing sides of the recess. The fold line 143 is approximately equal to the diameter of the recess or chime Bc in the bottom of the article B.

Figure 3:
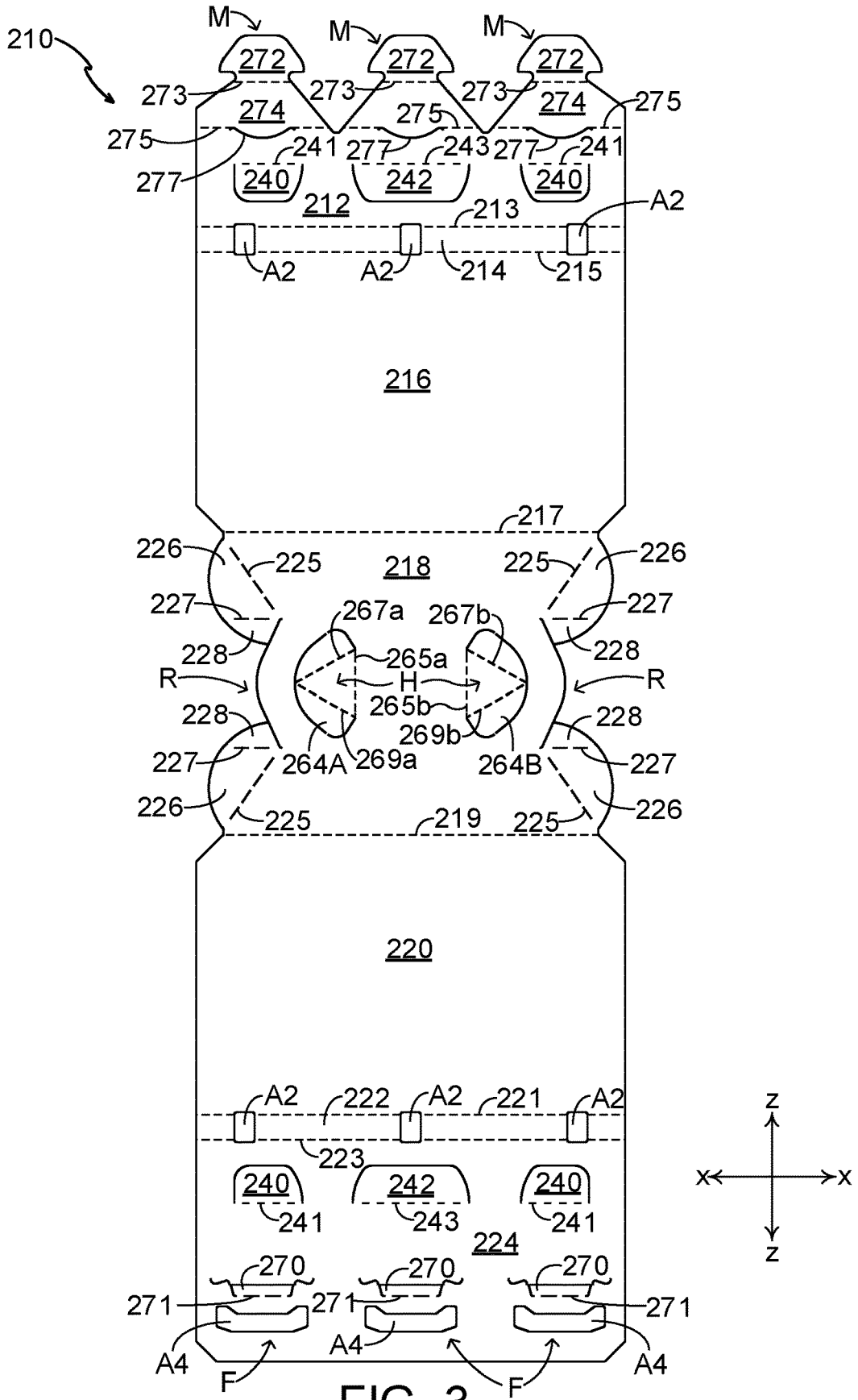
FIG. 3 is a plan view from above of a blank for forming an article carrier according to a third embodiment.

Referring now to FIG. 3, there is shown an additional embodiment of the present disclosure. In the third illustrated embodiment like numerals have, where possible, been used to denote like parts, albeit with the addition of the prefix "200" to indicate that these features belong to the third embodiment. The additional embodiment shares many common features with the previous embodiments and therefore only the differences from the embodiments illustrated in FIGS. 1 and 2 will be described in detail.

The handle structure H comprises a pair of openings. Each of the openings may be defined at least in part by a tab 264A, 264B. The illustrated embodiment comprises a pair of tabs 264A, 264B spaced apart from each other. The tabs 264A, 264B are hingedly connected to the top panel 218 by fold lines 265A, 265B and are defined in part by a cut line or severance line. A first one of the tabs 264A is hingedly connected to the top panel 218 in opposition to a second one of the tabs 264B.

The tabs 264A, 264B may comprise a pair of fold or score lines 267*a*, 269*b*; 267*b*, 269*b*. The pair of fold lines 267*a*, 269*b*; 267*b*, 269*b* may be arranged divergently with respect to each other. The pair of fold lines 267*a*, 269*b*; 267*b*, 269*b* may diverge towards the fold line 265A, 265B. The pair of fold lines 267*a*, 269*b*; 267*b*, 269*b* may converge with each other at a free edge of the tab 264A, 264B opposing the fold line 265A, 265B, in this way the pair of fold lines 267*a*, 269*b*; 267*b*, 269*b* and the fold line 265A, 265B may define a triangle.

The blank 210 comprises a panel locking device having a first part M and a second part F. The blank 210 comprises three panel locking devices. The first part M comprises a locking tab 272 hingedly connected to an intermediate tab 274 by a hinged connection in the form of a fold line 273. The locking tab 272 is substantially arrowhead shaped. The intermediate tab 274 is hingedly connected to the first base panel 212 by a hinged connection in the form of a fold line 275. The locking tabs 272 and the intermediate tabs 274 are wholly formed from the first base panel 212. The fold line 275 may be interrupted by a cut line 277. The cutline 277 may be nonlinear, in the illustrated embodiment the cutline 277 is arcuate or curvilinear. The cutline 277 defines in part a trailing tab 245 (see FIG. 3B). The trailing tab 245 forms a hooking element of the panel locking device.

The second part F comprises a receiver having an opening defined in part by a tab 270 hingedly connected to the second base panel 224 by a hinged connection in the form of a fold line 271. The opening is defined in part by cutline extending from opposed ends of the tab 270. The receiver comprises an aperture A4 spaced a part from the opening.

The opening is adapted to receive the locking tab 272 and the aperture A4 is adapted to receive the trailing tab 245 to lock the first and second base panels 212, 224 together.

Figure 3B:
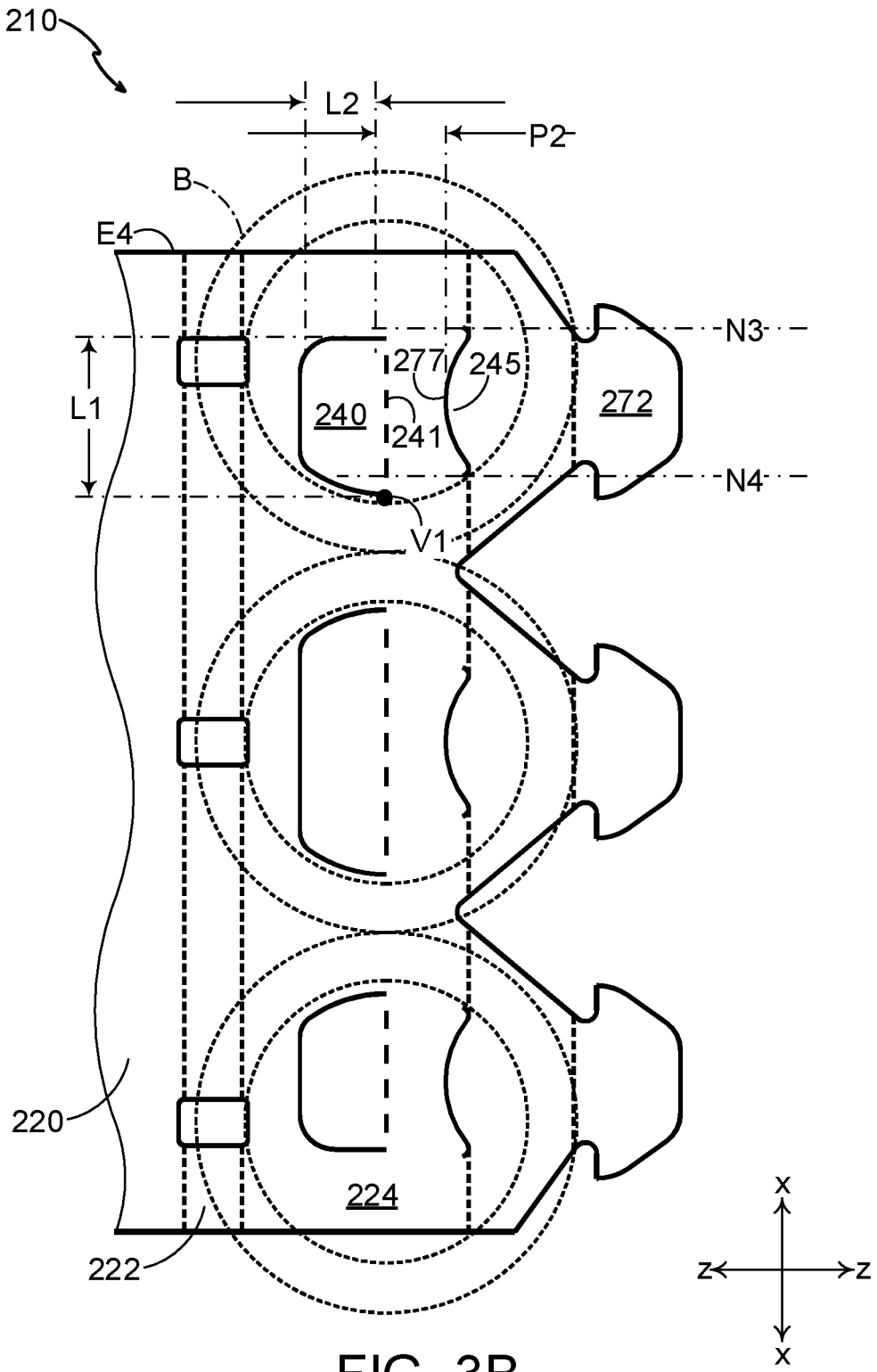
FIG. 3B is an enlarged plan view from above of a portion of the blank of FIG. 3.

FIG. 3B shows a portion of the blank 210, the second base panel 224, in relation to the base of a row of articles B.

The engaging tab 240 contacts the bottom of an article B at a contacting point V1, the contacting point V1 is located on an inside edge or surface of a recess in the base of the article B. The inside edge or surface of the recess in the base of the article B is indicated by a phantom or dashed line denoted by reference Bc. The phantom line Bc may indicate the location of a chime of an end of a beverage can. The contacting point V1 is located on an innermost portion of the recess of the article B.

The fold line 241 of the engaging tab 240 terminates at a terminal end approximately located at a position V1 on the bottom chime Bc of the article B, the position V1 is farthermost from the adjacent end edge E4 of the second base panel 224 (also referred to herein as a bottom lap panel).

The contacting point V1 is located at an innermost end of the fold line 241 hinging the engaging tab 240 the second base panel 224.

The engaging tab 240 has a length L1 and a width or height L2. The engaging tab 240 is spaced apart from the cutline 277 defining part of the trailing tab 245 by a second distance P2.

The length L2 of the engaging tab 240 is greater than the distance P2 between the fold line 241 and the cutline 277.

The fold line 241 is spaced apart from a notional line N3-N3 that is parallel to the longitudinal axis z-z of the blank 210. The notional line N3-N3 passes through, intersects or contacts the outer end of the adjacent cutline 277.

The fold line 18 intersects with a notional line N4-N4 that is parallel to the longitudinal axis z-z of the blank 210. The notional line N4-N4 passes through, intersects or contacts the inner end of the adjacent cutline 277.

The fold line 241 is parallel to the tubular axis of the carrier formed from the blank 110.

The engaging tab 241 engages the recess in the base of the article B at an innermost point V1 on the recess. The perimeter of the recess at the point of contact between the article B and the second base panel 224 is denoted by dashed line Bc.

The fold line 241 is arranged to extend radially with respect to the article B.

Figure 4:
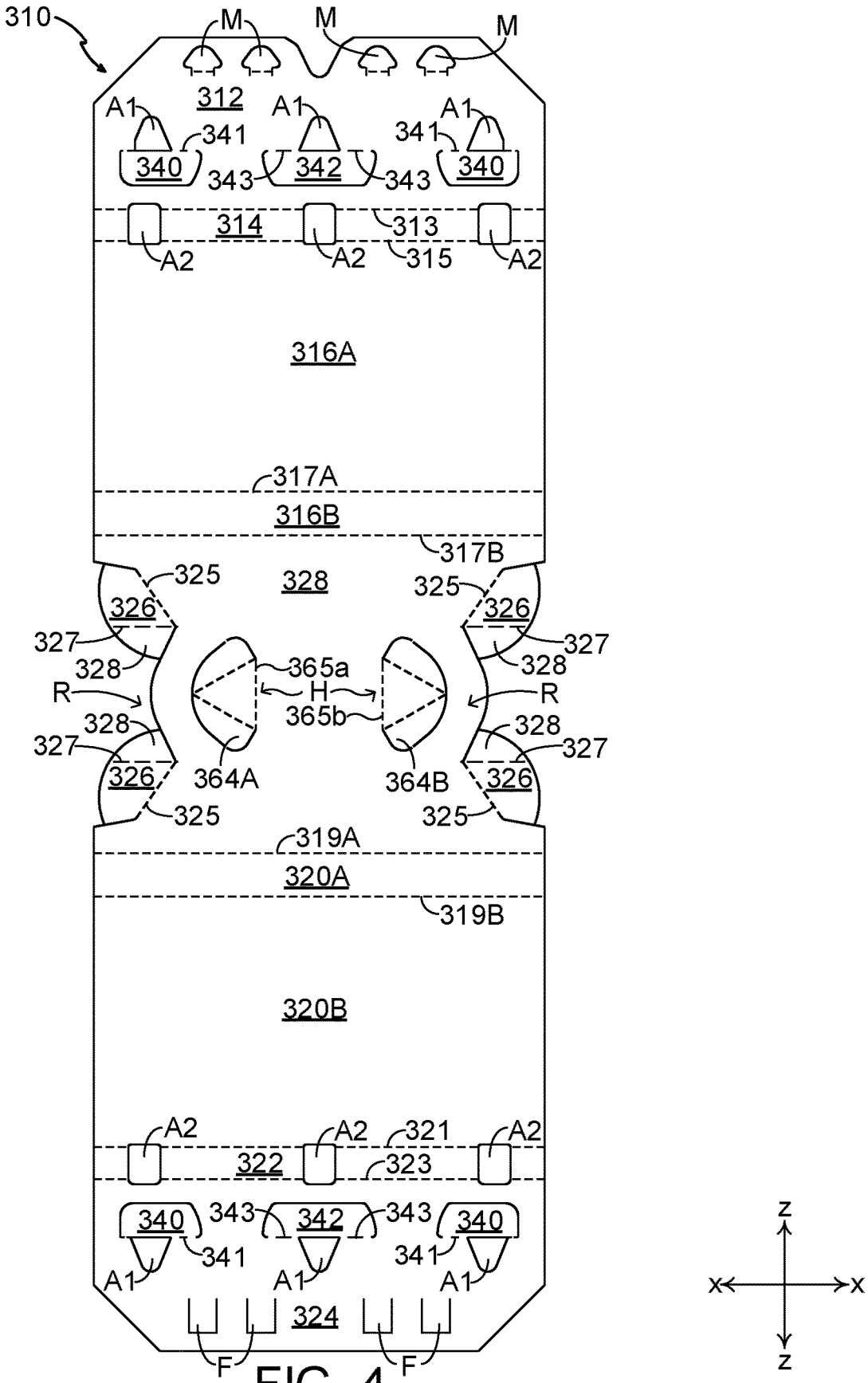
FIG. 4 is a plan view from above of a blank for forming an article carrier according to a fourth embodiment.

Referring now to FIG. 4, there is shown an additional embodiment of the present disclosure. In the fourth illustrated embodiment like numerals have, where possible, been used to denote like parts, albeit with the addition of the prefix "300" to indicate that these features belong to the fourth embodiment. The additional embodiment shares many common features with the previous embodiments and therefore only the differences from the embodiments illustrated in FIGS. 1 to 3 will be described in detail.

The blank 310 comprises a third corner or bevel panel 316B hingedly connected to a first side panel 316A by a hinged connection in the form of a fold line 317A. The third corner panel 316B is hingedly connected to the top panel 318 by a hinged connection in the form of a fold line 317B.

The blank 310 comprises a fourth corner or bevel panel 320A hingedly connected to a second side panel 320B by a hinged connection in the form of a fold line 319B. The fourth corner panel 320A is hingedly connected to the top panel 318 by a hinged connection in the form of a fold line 319A.

The third and fourth corner panels 316B, 320A may be considered to form part of the top panel 318 or part of the respective one of the first and second side panels 316A, 320B to which they are hinged.

The article engagement structures comprise a flap 326 hingedly connected to the top panel 318 by a hinged connection in the form of a fold line 325. The flap 326 is partially separated from the top panel 318 by a first cutline. A wing tab 328 is hingedly connected to the flap 326 by a hinged connection in the form of a fold line 327. The wing tab 328 is separated from the top panel 318 by a second cutline.

The blank 310 comprises a pair of article engagement structures at each end of the top panel 318. The flaps 326 of each pair of article engagement structures are spaced apart from each other to define, in part, a gap therebetween, the gap forming a part of a recess R in top panel 318. The flaps 326 define, in part, the recess R in each end of the top panel 318.

The flaps 326 when folded out of the plane of the top panel 318 increase the size of the recess R. The recess R is defined wholly within the top panel 318.

The blank 310 comprises a pair of endmost lower article retention structures (also referred to herein as partial lower article retention structures) for engaging articles disposed proximate the first and second ends of the carrier. The endmost lower article retention structures each comprise a first engaging tab 340 struck from, or defined within, one of the first and second base panels 312, 324. The first engaging tab 340 (also referred to herein as a partial engaging tab 340) is hingedly connected to said one of the first and second base panels 312, 324 by a hinged connection in the form of a fold line 341. The blank 310 comprises a first aperture A1 arranged to be adjacent to the first engaging tab 340, such that the first aperture A1 interrupts the hinged connection 341 between the first engaging tab 340 and the respective one of the first and second base panels 312, 324.

The blank 310 comprises an intermediate lower article retention structures (also referred to herein as a full lower article retention structure) for engaging an article disposed medially of the carrier, that is to say an article disposed between endmost articles. The intermediate lower article retention structure comprises a second engaging tab 342 struck from, or defined within, one of the first and second base panels 312, 324. The second engaging tab 342 (also referred to herein as a full engaging tab 340) is hingedly connected to said one of the first and second base panels 312, 324 by a hinged connection in the form of a fold line 343. The blank 310 comprises a first aperture A1 arranged to be adjacent to the second engaging tab 342, such that the first aperture A1 interrupts the hinged connection 343 between the second engaging tab 342 and the respective one of the first and second base panels 312, 324.

Figure 4B:
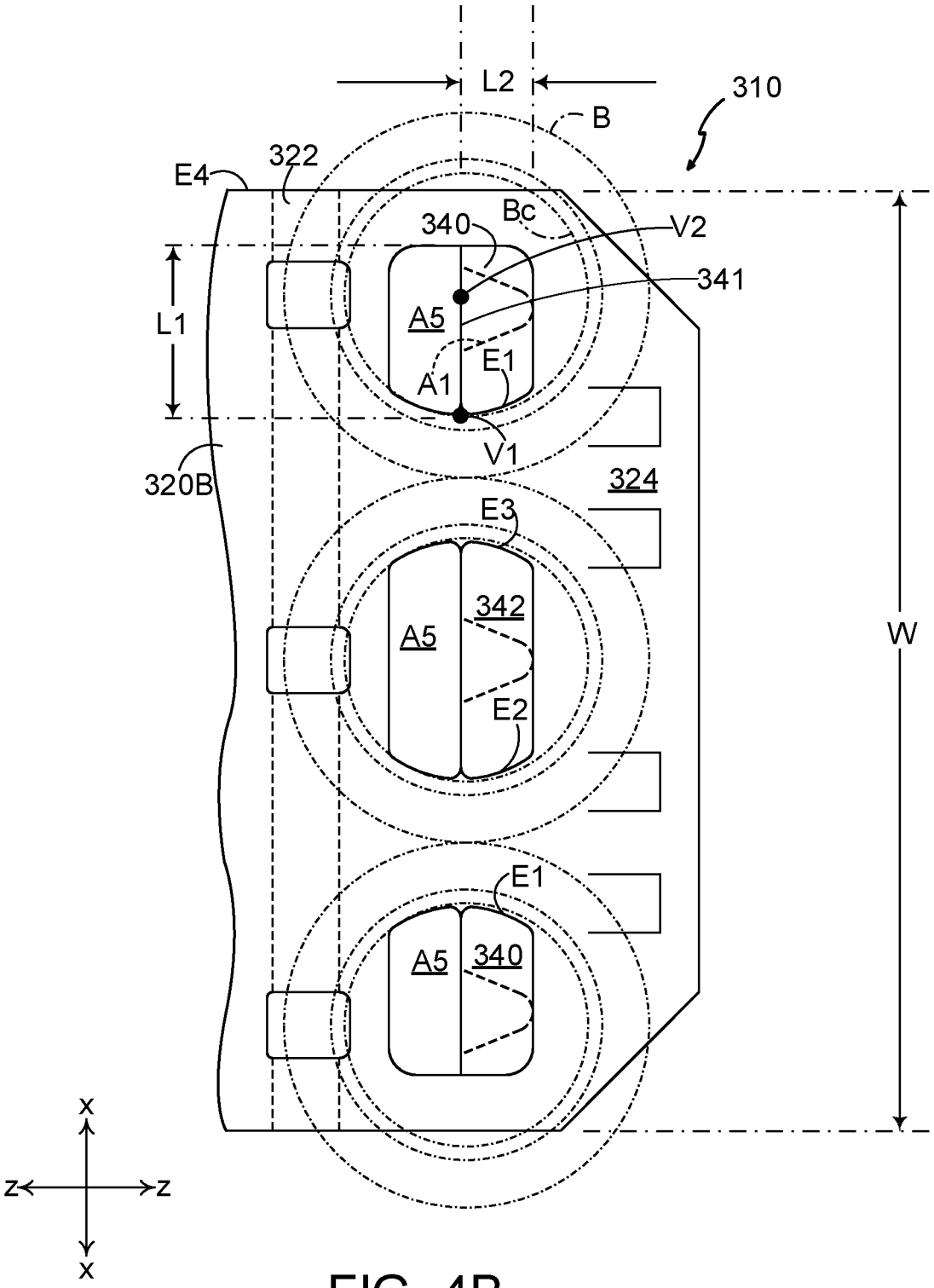
FIG. 4B is an enlarged plan view from above of a portion of the blank of FIG. 4.

FIG. 4B illustrates the alignment and/or positioning of the base of the article B with respect to the second base panel 324. The first engaging tabs 340 comprise an engaging edge E1 for engaging a portion of the recess in the base of the article B. The first engaging tabs 340 are arranged to prevent or inhibit movement of the article outwardly of the carrier particularly in a longitudinal direction.

The second engaging tab 342 comprise a first engaging edge E2 and a second engaging edge E3 for engaging portions of the recess in the base of the article B. The first engaging edge E2 and a second engaging edge E3 are arranged in opposition to each other. The second engaging tab 342 is arranged to prevent or inhibit movement of the article of the carrier longitudinally in either direction.

The engaging tabs 340, 342 are illustrated in a folded configuration and an opening A5 is created in the second base panel 324 as a result. The machine access openings A1 are illustrated by dashed lines and are disposed below the engaging tab 340.

The engaging tab 340 contacts the bottom of an article B at a contacting point V1, the contacting point V1 is located on an inside edge or surface of the recess in the base of the article B. The inside edge or surface of the recess in the base of the article B is indicated by a phantom or dashed line denoted by reference Bc. The phantom line Bc may indicate the location of a chime of an end of a beverage can. The contacting point V1 is located on an innermost portion of the recess of the article B. The contacting point V1 and the central or tubular axis V2 of the article B define a notional line extending in a lateral direction with respect to the blank 310; the lateral axis or direction of the blank 310 is denoted by direction arrow x-x. The longitudinal direction of the blank 310 is denoted by direction arrow z-z.

The lateral axis x-x is parallel to a tubular axis of the carrier 90.

The fold line 341 of the engaging tab 340 terminates approximately at a position V1 on the bottom chime Bc of the article B, the position V1 is farthermost from the adjacent end edge E4 of the second base panel 324 (also referred to herein as a bottom lap panel).

The contacting point V1 is located at an innermost end of the fold line 341 hinging the engaging tab 340 the second base panel 324. The fold line 341 terminates at a location between the tubular axis V2 of the article B and the adjacent end edge E4 of the second base panel 324.

The engaging tab 340 has a length L1 and a width or height L2. The engaging tab 340 is spaced apart from the first aperture A1 by a first distance P1.

The fold line 341 intersects with the cylindrical axis V2 of the article or passes through the centre V2 of the end or chime Bc of the article B. The length L1 of the fold line 341 is greater than half of the diameter of the bottom chime Bc or recess.

The fold line 341 is parallel to the tubular axis of the carrier formed from the blank 310.

The fold line 341 extends away from the adjacent end edge E4 of the second base panel 324 beyond the inner end of the machine access opening A1.

The engaging tab 340 engages the recess in the base of the article B. The perimeter of the recess at the point of contact between the article B and the second base panel 324 is denoted by dashed line Bc. The engaging tab 340 engages the recess in the base of the article B at an innermost point V1 on the recess.

The fold line 341 is arranged to extend radially with respect to the article B.

Figure 5:
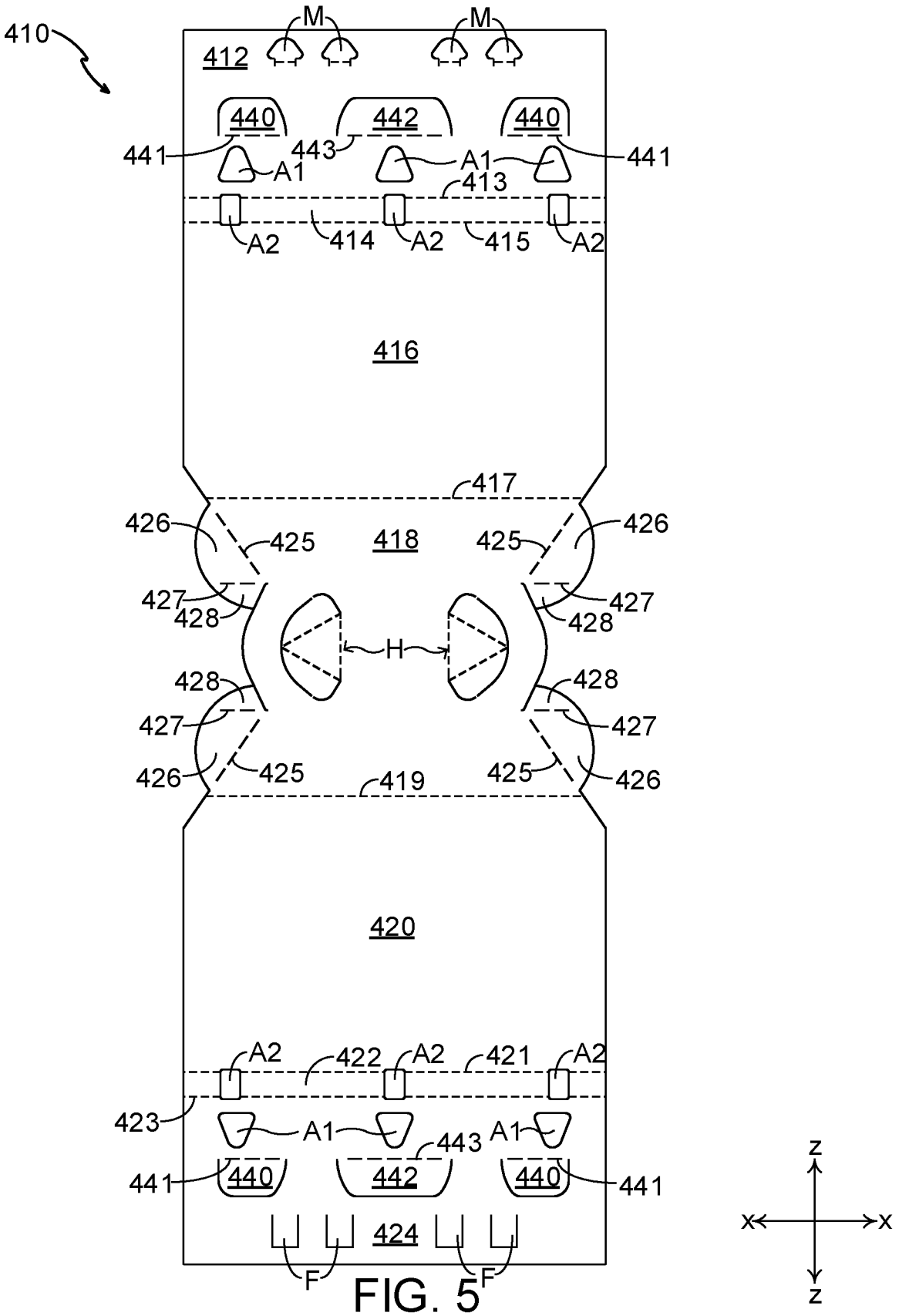
FIG. 5 is a plan view from above of a blank for forming an article carrier according to a fifth embodiment.

Referring now to FIG. 5, there is shown an additional embodiment of the present disclosure. In the fifth illustrated embodiment like numerals have, where possible, been used to denote like parts, albeit with the addition of the prefix "400" to indicate that these features belong to the fifth embodiment. The additional embodiment shares many common features with the previous embodiments and therefore only the differences from the embodiments illustrated in FIGS. 1 to 4 will be described in detail.

FIG. 5 illustrates a blank 410 adapted to package six articles arranged in a 3×2 matrix or array. The blank 310 comprises the handle structure H of the embodiment of FIG. 3.

The location of the first apertures A1 with respect to the engaging tabs 440, 442 has been altered. Whereas in the embodiments of FIGS. 1, 2 and 3 the first apertures A1 were disposed in closer proximity to a free end of the base panel 12, 24; 112,124; 212, 224 than the engaging tabs 40, 42; 140, 142; 240, 242 in the embodiment of FIG. 5 the first apertures A1 are disposed in closer proximity to the hinged connection, to fold line 413, 423, between the base panel 412, 424 and the adjacent one of the first and second corner panels 414, 422 than the engaging tabs 440, 442.

The engaging tabs 440, 442 are disposed in closer proximity to the free end of the base panel 412, 424 than the first apertures A1. The free end opposes said hinged connections, fold lines 413, 423 between the base panel 412, 424 and the respective one of the first and second corner panels 414, 422.

In the embodiment of FIG. 5 the engaging tabs 440, 442 are hinged to the respective first or second base panel 412, 424 so as to fold in an opposite direction to the engaging tabs of the previous embodiments. In the embodiment of FIG. 5 the fold lines 441, 443 are disposed closer to the respective hinged connection (fold line 413, 423) between the first or second base panel 412, 424 and the first or second corner panel 414, 422 than an opposing free edge of the engaging tabs 440, 442. The engaging tab 440, 442 are folded towards said respective hinged connection when in use. In the previous embodiments the engaging tabs are folded towards a free end edge of the first or second base panel when in use.

Figure 6:
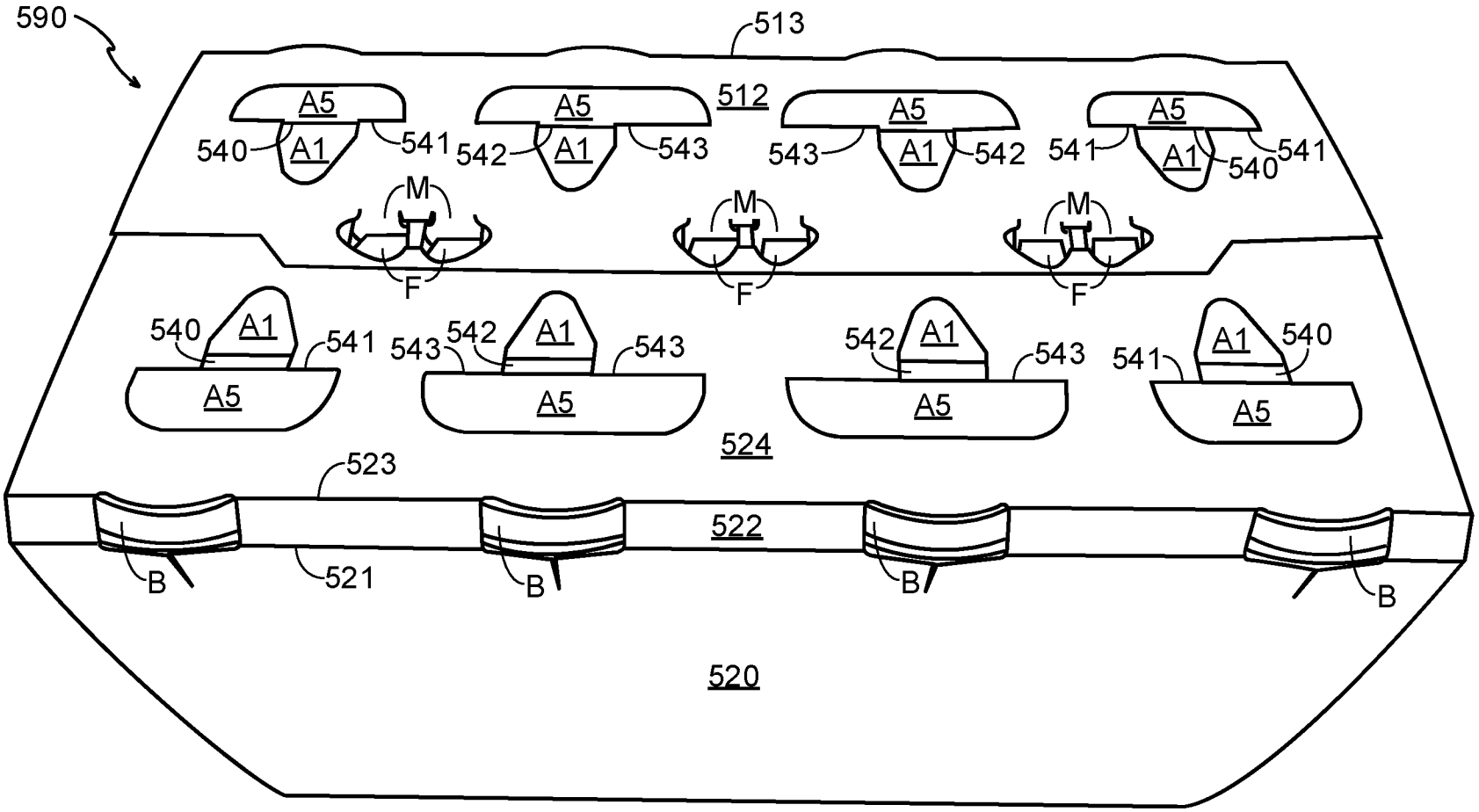
FIGS. 6 and 7 are perspective views from below of an article carrier according to a sixth embodiment.
Figure 7:
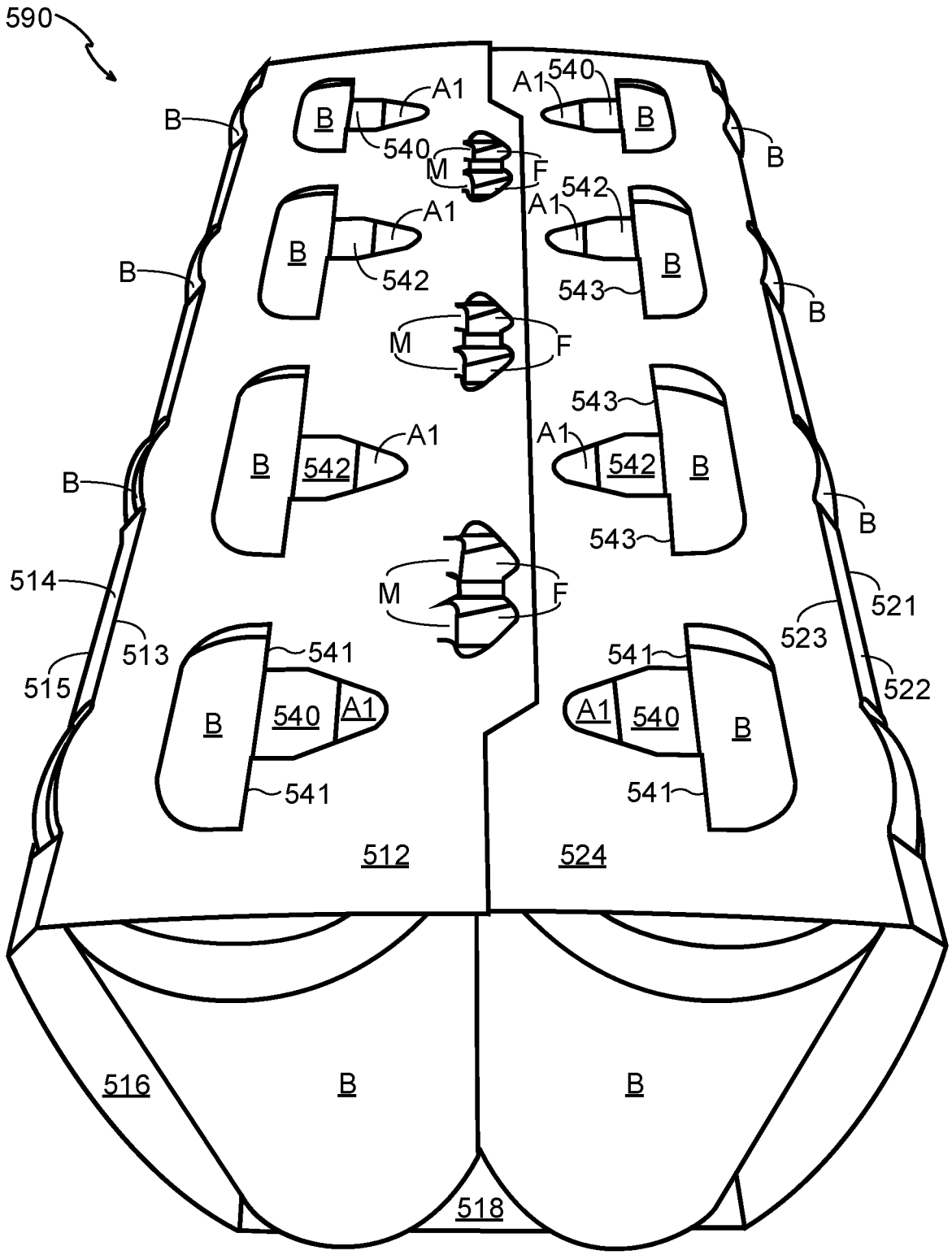

Referring now to FIGS. 6 and 7, there is shown an additional embodiment of the present disclosure. In the sixth illustrated embodiment like numerals have, where possible, been used to denote like parts, albeit with the addition of the prefix "500" to indicate that these features belong to the sixth embodiment. The additional embodiment shares many common features with the previous embodiments and therefore only the differences from the embodiments illustrated in FIGS. 1 to 5 will be described in detail.

FIGS. 6 and 7 illustrate a carrier 590 packaging a plurality of articles B. The carrier 590 is adapted to accommodate eight articles B in a 4×2 matrix or array. FIGS. 6 and 7 illustrate first and second base panels 512, 524 secured together to form a composite base panel 512/524. The first and second base panels 512, 524 are secured together by a complementary locking arrangement comprising a first part M and a second part F. The first part M comprises at least one male tab hingedly connected to the first base panel 512. The second part F comprises an opening forming a receiver, the opening is defined by a female tab hingedly connected to the second base panel 524.

First engaging tabs 540 have been folded internally of the carrier 590 to engage a portion of the recess in the base of a respective article B. The first engaging tabs 540 are received in the recess in the base of the respective article B. Folding the first engaging tabs 540 creates an opening A5 in the base panels 512, 524. The first engaging tabs 540 are arranged to prevent or inhibit movement of the article B outwardly of the carrier 590 particularly in a longitudinal direction.

Second engaging tabs 542 have been folded internally of the carrier 590 to engage a portion of the recess in the base of a respective article B. The second engaging tabs 542 are received in the recess in the base of the respective article B. Folding the second engaging tabs 542 creates an opening A5 in the base panels 512, 524. The second engaging tab 542 is arranged to prevent or inhibit movement of the article B of the carrier 590 longitudinally in either direction.

Figure 8:
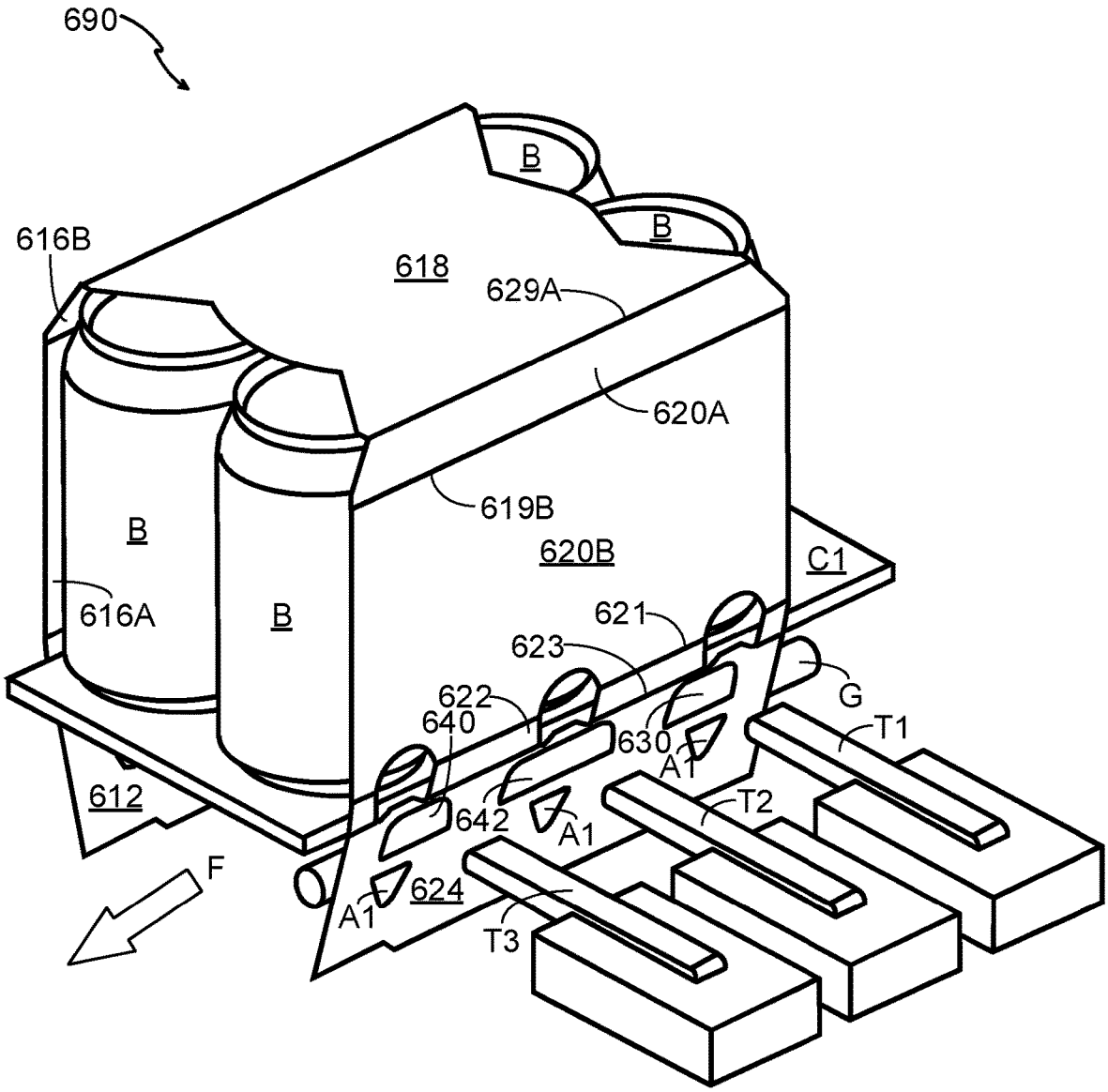
FIGS. 8, 9 and 10 illustrate stages of construction of an article carrier according to a seventh embodiment.
Figure 9:
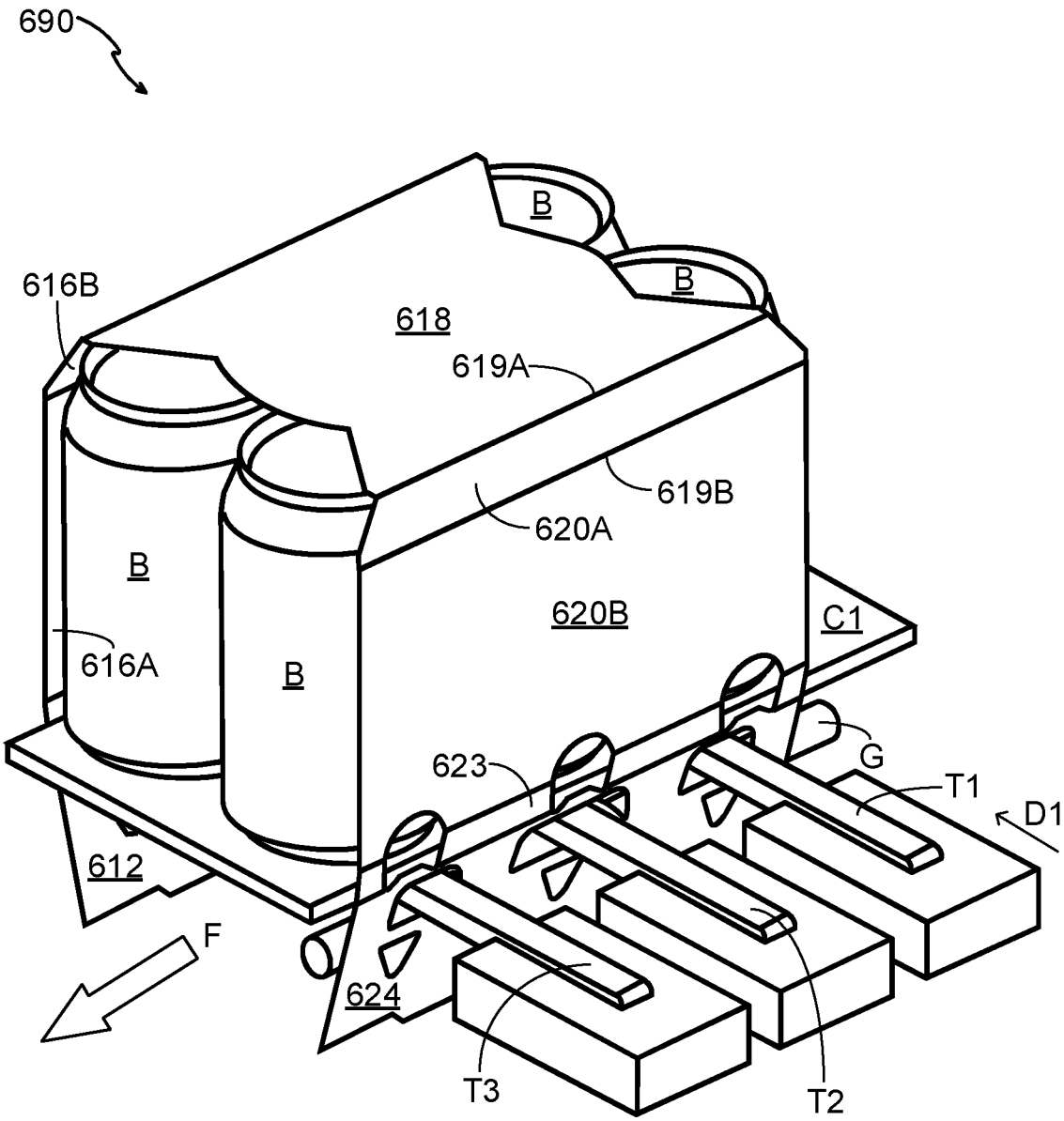
Figure 10:
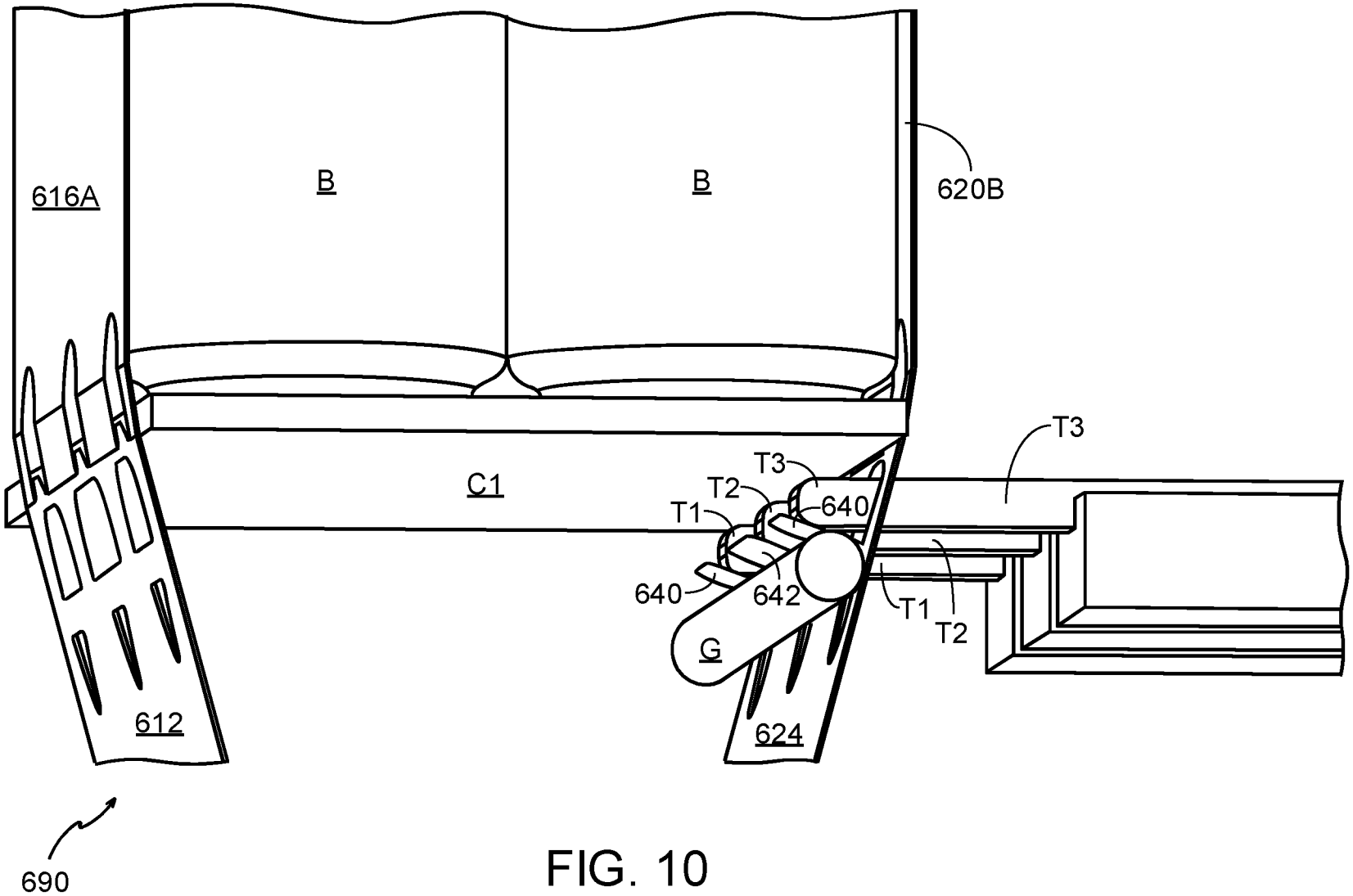

Referring now to FIGS. 8 to 10, there is shown an additional embodiment of the present disclosure. In the seventh illustrated embodiment like numerals have, where possible, been used to denote like parts, albeit with the addition of the prefix "600" to indicate that these features belong to the seventh embodiment. The additional embodiment shares many common features with the previous embodiments and therefore only the differences from the embodiments illustrated in FIGS. 1 to 7 will be described in detail.

FIGS. 8 to 10 illustrates stage of construction of a blank into a carrier 690. The carrier 690 can be formed by a series of sequential folding operations in a straight line machine so that the carrier 690 is not required to be rotated or inverted to complete its construction. The folding process is not limited to that described below and may be altered according to particular manufacturing requirements.

A group of articles B is assembled; in the embodiment illustrated in FIGS. 8 to 10 six articles B are arranged in a 2×3 array. A top panel 618 of a blank is disposed above the group of articles B to provide a top wall 618 of the carrier 690.

The flaps of upper article engagement structures are folded into face to face relationship with the top panel 618. A first pair of flaps at a first one of the first and second ends of the top panel 618 may be folded prior to folding a second pair of flaps at the other one of the first and second ends of the top panel 618.

The flaps of the upper article engagement structures may be folded by a part of a packaging machine such as but not limited to a passive device such as a static guide or an active device such as a folding wheel or by a combination of active and passive devices.

In one example the blank is oriented transversely with respect to a conveyor C1, such that the flaps at a first end of the top panel 618 lead (are downstream of) the flaps at a second end of the top panel 618.

The leading flaps may be folded by a static guide which retards movement of the flaps with respect to the blank to effect folding of the flaps.

The trailing (upstream) flaps may be folded by an active tool or guide which accelerates movement of the flaps with respect to the blank to effect folding of the flaps.

Once the flaps of the upper article engagement structures are folded into face to face relationship with the top panel 618 the blank is moved relative to the group of articles B so as to be disposed over upper ends of the articles B.

The flaps may be received in a recess or void in the upper end of the articles B.

The flaps may be arranged to abut a portion of the articles B providing an abutment face or be located in close proximity to the abutment face so as to inhibit movement of the articles B with respect to the article carrier 690.

Third and fourth bevel panels 616B, 620A (when present) are folded, with respect to the top panel 618 about respective fold lines 619A, about shoulders of the group of articles B.

The first and second side panels 616A, 620B are folded, with respect to the third and fourth bevel panels 616B, 620A to which they are hinged. The first and second side panels 616A, 620B are folded, about respective fold lines, about opposing sides of the group of articles B so as to be disposed about the opposing sides of the group of articles B so as to form first and second side walls 616A, 620B of the carrier 690.

The first engaging tabs 640 and second engaging tabs 642 are folded out of the plane of the first and second base panels 612, 624, prior to folding the first and second base panels 612, 624 about the base of the group of articles B.

The first and second engaging flaps 640, 642 may be folded by a tool T1, T2, T3. The tool T1, T2, T3 is moved transversely, as indicated by direction arrow D1 in FIG. 9, with respect to the direction of flow F of the carrier 690 on the conveyor C1. FIG. 10 illustrates the tool T1, T2, T3 folding the first and second engaging flaps 640, 642 out of the plane of the second base panel 624. A guide G may be provided to restrict or inhibit movement of the second base panel 624 while the first and second engaging flaps 640, 642 are folded. The packaging machine may be similarly arranged to fold engaging tabs in the first base panel 612. A further guide (not shown) may be provided to facilitate this.

The first and second corner panels 622 (when present) are folded, with respect to the respective one of the first and second side panels 616A, 620B, about respective fold lines, about the heels or lower portions of adjacently disposed articles B.

The second base panel 624 is folded so as to be disposed adjacent to the base of the group of articles B. The first base panel 612 is then folded so as to be in at least partial overlapping relationship with the second base panel 624; in doing so each of the engaging tabs 640, 642 may be brought into engagement with a base of a respective article B.

The first and second base panels 612, 624 are secured together to form an assembled carrier 690.

The flaps of the upper article engagement structures engage a rim, chime or upstanding wall or other projection of the article B at an upper end thereof. When the articles B are cans the top wall of the can may be countersunk, disposed below the upper end of the side wall or end seam of the article B. The top wall of the can is connected to the side walls by a can chime or end seam.

The flaps of the upper article engagement structures engage an internal surface or abutment face of the rim. The flaps of the upper article engagement structures may be disposed in the recess or void provided by a countersunk top wall of the article B.

The flaps of the upper article engagement structures remain in engagement with the articles B when the carrying handle H is in use, the flaps may unfold—at least partially, due to the inherent resilience or elasticity of the carrier substrate, upon upward displacement of the top panel 618 with respect to the group of articles B.

The engaging tabs 640, 642 of the lower article engagement structures engage an internal surface or abutment face of a recess or chime in the bottom wall of the articles B. Each article B is engaged by one of engaging tabs 640, 642.

The present disclosure provides an article carrier 590, 690 for packaging one or more articles B each having a recess. The article carrier 590, 690 comprising a plurality of panels 12, 14, 16, 18, 20, 22, 24; 112, 114, 116, 118, 120, 122, 124; 212, 214, 216, 218, 220, 222, 224; 312, 314, 316A, 316B, 318, 320A, 320B, 322, 324; 412, 414, 416, 418, 420, 422, 424; 512, 514, 516, 518, 520, 522, 524; 612, 616A, 616B, 618, 620A, 620B, 622, 624 forming a tubular structure for surrounding at least one article B and a lower article retention device for engaging a recess of one of said one or more articles B to prevent or inhibit dislodgement or unintentional egress of the article B from at least one of opposite open ends of the tubular structure. The lower article retention device comprises an engaging tab 40, 42; 140, 142; 240, 242; 340, 342; 440, 442; 540, 542; 640, 642 hingedly connected to one of the plurality of panels, said one of the plurality of panels may be a base panel 12, 24, 112, 124; 212, 224; 312, 324; 412, 424; 512, 524, 612, 624.

In some embodiments, the point of contact V1 between the engaging tab 40, 42; 140, 142; 240, 242; 340, 342; 440, 442; 540, 542; 640, 642 and the inside surface of the recess or chime in the bottom of the article B is farthermost from the adjacent end edge E4 of a respective one of a pair of bottom lap panels 12, 24, 112, 124; 212, 224; 312, 324; 412, 424; 512, 524, 612, 624.

The engaging tab 40, 42; 140, 142; 240, 242; 340, 342; 440, 442; 540, 542; 640, 642 is hingedly connected to said one of the plurality of panels by a fold line 41, 43; 141, 143; 241, 243; 341, 343; 441, 443; 541, 543.

An article B is located with respect to the base panel 12, 24, 112, 124; 212, 224; 312, 324; 412, 424; 512, 524, 612, 624 such that the fold line 41, 43; 141, 143; 241, 243; 341, 343; 441, 443; 541, 543 of the engaging tab 40, 42; 140, 142; 240, 242; 340, 342; 440, 442; 540, 542; 640, 642 terminates approximately at a position V1 on a bottom chime Bc of an article B. The position V1 is farthermost from the adjacent end edge E4 of a respective one of a pair of bottom lap panels 12, 24, 112, 124; 212, 224; 312, 324; 412, 424; 512, 524, 612, 624.

Advantageously, this allows reduction of the width W of the blank 10, 110; 210; 310; 410. It may increase the article-retaining strength of the carrier 590; 690 and may increase the stability of the article B within the carrier 590; 690.

The fold line 41, 43; 141, 143; 241, 243; 341, 343; 441, 443; 541, 543 may intersect with a cylindrical axis V2 of the article B or pass through the centre V2 of a chime Bc in the bottom of the article B.

The length L1 of the fold line 41, 43; 141, 143; 241, 243; 341, 343; 441, 443; 541, 543 may be equal to, or greater than, half of the diameter of the bottom chime Bc.

The fold line 41, 43; 141, 143; 241, 243; 341, 343; 441, 443; 541, 543 may be parallel to the tubular axis of the carrier 590; 690.

In some embodiments, the width L2 of the engaging tab 40, 42; 140, 142; 440, 442 is greater than the distance P1 between the fold line 41, 43; 141, 143; 441, 443 and the adjacent machine access opening A1.

In some embodiments, the length of the fold line 43; 143; 243; 343; 443; 543 is approximately equal to the diameter of the recess or chime Bc in the bottom of the article B.

The fold line 41, 43; 141, 143; 241, 243; 341, 343; 441, 443; 541, 543 intersects with a notional line N1-N1 that is parallel to the longitudinal axis z-z of a carton blank 10; 110; 210; 310; 410 and that passes through the inner end of the adjacent machine access opening A1.

In some embodiments, the fold line 41, 43; 141, 143 intersects with a notional line N2-N2 that is parallel to the longitudinal axis z-z of a carton blank 10; 110 and that passes through the outer end of the adjacent male locking tab M or female locking tab F.

In some embodiments, the blank 210 comprises a panel locking device including a locking tab 272 which is formed solely from the first base panel 212. The width L2 of the locking tab 272 is greater than the distance P2 between the fold line 18 and a cutline 277 defining a hooking element of the panel locking device.

The fold line 241, 243, or at least a second terminal end of the fold line, may be spaced apart from a notional line N3-N3 that is parallel to the longitudinal axis z-z of the carton blank 210. The second terminal end opposes a first terminal end which may be in contact with the article B. The fold line 241, 243 passes through the outer end of the adjacent cutline 277.

The fold line 241, 243 intersects with a notional line N4-N4 that is parallel to the longitudinal axis z-z of the carton blank 210. The fold line 241, 243 passes through the inner end of the adjacent cutline 277.

The article carrier 590, 690 may be of the wrap-around type, comprising a composite wall formed from two panels secured together. The composite wall may be a bottom wall of the tubular structure.

It can be appreciated that various changes may be made within the scope of the present invention. For example, the size and shape of the panels and apertures may be adjusted to accommodate articles of differing size or shape. The illustrated embodiments show cartons or blanks for forming an article carrier of the wraparound style; in other embodiments, the article carrier may take an alternative format or styles and may employ one or more of the features of the present disclosure.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A package comprising a group of articles and an article carrier, each of the articles of the group having a cylindrical portion and a bottom chime, the cylindrical portion having a first diameter, the bottom chime having a chime diameter less than the first diameter, the bottom chime defining a recess at a bottom of the each of the articles, the article carrier comprising a plurality of panels, including a base panel, forming a tubular structure surrounding the group of articles and an article retention structure in engagement with the recess of an endmost one of the articles of the group to prevent or inhibit egress of the endmost one of the articles from at least one of opposite open ends of the tubular structure, the article retention structure comprising an engaging tab hingedly connected to the base panel, wherein the engaging tab is arranged to engage an inside surface of the recess of the endmost one of the articles such that a part of the bottom chime of the endmost one of the articles extends outwardly beyond an adjacent end edge of the base panel wherein the engaging tab is disposed to engage the inside surface of the recess at a point farthermost from the adjacent end edge of the base panel.

2. A package according to claim 1 wherein the engaging tab is formed entirely from the base panel.

3. A package according to claim 1 wherein the tubular structure defines a tubular axis of the carrier, and wherein the engaging tab is hingedly connected to the base panel along a tab fold line parallel to the tubular axis.

4. A package according to claim 3 wherein the plurality of panels further comprises a first panel hingedly connected to the base panel along a first fold line which is parallel to the tubular axis, wherein the engaging tab is folded about the tab fold line to extend away from the first fold line such that the engaging tab engages the recess.

5. A package according to claim 3 wherein the tab fold line has a length that is greater than or equal to half of the chime diameter.

6. A package according to claim 1 wherein the point and the adjacent edge of the base panel are disposed a distance apart from each other, the distance being less than the chime diameter.

7. An article carrier for packaging at least one article each having a recess in a bottom wall, the article carrier comprising a plurality of panels, including a base panel, forming a tubular structure for surrounding at least one article and an article retention structure for engaging the recess of one of the at least one article to prevent or inhibit egress of the article from at least one of opposite open ends of the tubular structure, the article retention structure comprising an engaging tab hingedly connected to the base panel, wherein the engaging tab is arranged to contact an inside surface of the recess in the bottom wall of the article at a point farthermost from an adjacent end edge of the base panel of the article carrier.

8. An article carrier according to claim 7 wherein the point and the adjacent edge of the base panel are disposed a distance apart from each other, the distance being less than a diameter of the recess in the bottom wall of the at least one article.

9. An article carrier according to claim 7 wherein the base panel is formed from a pair of bottom lap panels.

10. An article carrier according to claim 7 wherein the engaging tab is hingedly connected to the base panel by a fold line.

11. An article carrier according to claim 10 wherein the fold line of the engaging tab is arranged to terminate at a position on a bottom chime of an article which is farthermost from the adjacent end edge of the base panel.

12. An article carrier according to claim 10 wherein the fold line is arranged to pass through the center of the recess in the bottom wall of the article.

13. An article carrier according to claim 10 wherein the fold line is arranged to intersect with a cylindrical axis of the article.

14. An article carrier according to claim 10 wherein the fold line has a length that is greater than or equal to half of a diameter of a bottom chime of the at least one article.

15. An article carrier according to claim 10 wherein the fold line has a length that is greater than or equal to half of a diameter of the recess in the bottom wall of the article.

16. An article carrier according to claim 10 wherein the fold line is: parallel to a tubular axis of the carrier, or oriented longitudinally of the carrier, or both parallel to a tubular axis of the carrier and oriented longitudinally of the carrier.

17. An article carrier according to claim 10 wherein a width of the engaging tab is greater than a distance between the fold line and an adjacently disposed machine access opening.

18. An article carrier according to claim 10 wherein the fold line intersects with a notional line oriented transversely of the carrier and that passes through at least one of: (i) an inner end of an adjacent machine access opening, and (ii) an outer end of an adjacent male locking tab or female locking tab.

19. A package comprising a group of articles and an article carrier, the article carrier comprising a plurality of panels, including a base panel, forming a tubular structure surrounding the group of articles and an article retention structure in engagement with the recess of an endmost one of the articles of the group to prevent or inhibit egress of the endmost one of the articles from at least one of opposite open ends of the tubular structure, the article retention structure comprising an engaging tab hingedly connected to the base panel, wherein the engaging tab is arranged to engage an inside surface of the recess of the endmost one of the articles such that a part of the bottom chime of the endmost one of the articles extends outwardly beyond an adjacent end edge of the base panel wherein the engaging tab is disposed adjacent to an opening, wherein the engaging tab is configured to extend away from the opening in a blank form, and wherein the engaging tab is configured to extend towards the opening when folded inwardly in a carrier form.

20. The package according to claim 19 wherein the engaging tab is hingedly connected to the base panel by a fold line and a width of the engaging tab is greater than a distance between the fold line and the opening.

* * * * *